US012601484B2

(12) United States Patent
Chakraborty et al.

(10) Patent No.: US 12,601,484 B2
(45) Date of Patent: Apr. 14, 2026

(54) TURBINE ENGINE COMBUSTOR WITH A DILUTION PASSAGE

(71) Applicant: GENERAL ELECTRIC COMPANY, Cincinnati, OH (US)

(72) Inventors: Aritra Chakraborty, Bengaluru (IN); Perumallu Vukanti, Bengaluru (IN); Pradeep Naik, Bengaluru (IN); Arijit Sinha Roy, Bengaluru (IN); Bhavya Naidu Panduri, Hanamkonda (IN); R Narasimha Chiranthan, Bengaluru (IN); Ajoy Patra, Bengaluru (IN); Michael T. Bucaro, Arvada, CO (US); Sibtosh Pal, Mason, OH (US); Pabitra Badhuk, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 102 days.

(21) Appl. No.: 18/768,665

(22) Filed: Jul. 10, 2024

(65) Prior Publication Data

US 2025/0116402 A1 Apr. 10, 2025

Related U.S. Application Data

(63) Continuation of application No. 18/187,773, filed on Mar. 22, 2023, now Pat. No. 12,060,995.

(51) Int. Cl.
*F23R 3/06* (2006.01)

(52) U.S. Cl.
CPC ..... *F23R 3/06* (2013.01)

(58) Field of Classification Search
CPC ..... F23R 3/002; F23R 3/04; F23R 3/06
See application file for complete search history.

(56) References Cited

U.S. PATENT DOCUMENTS

| | | | | |
|---|---|---|---|---|
| 3,545,202 | A | 12/1970 | Batt | |
| 5,289,687 | A * | 3/1994 | Kress | F23R 3/283 60/752 |
| 6,675,587 | B2 * | 1/2004 | Graves | F23R 3/04 60/752 |
| 8,281,600 | B2 | 10/2012 | Chen et al. | |
| 8,904,799 | B2 | 12/2014 | Toqan et al. | |
| 9,062,884 | B2 | 6/2015 | Rudrapatna et al. | |
| 10,563,584 | B2 | 2/2020 | Shenny et al. | |
| 10,612,781 | B2 | 4/2020 | Cunha et al. | |

(Continued)

FOREIGN PATENT DOCUMENTS

EP 2423599 A2 2/2012

OTHER PUBLICATIONS

European Communication for Application No. 24 150 433.1 dated Oct. 30, 2025, 6 pages.

*Primary Examiner* — Steven M Sutherland
(74) *Attorney, Agent, or Firm* — Carter, DeLuca & Farrell LLP

(57) ABSTRACT

A combustor comprising a dome wall, a combustor liner extending from the dome wall, and a combustion chamber at least partially defined by the dome wall and the combustor liner. A set of fuel cups are arranged along the dome wall. A set of dilution passages extend through the dome wall or the combustor liner to direct air into the combustion chamber, wherein a dilution passage of the set of dilution passages includes an inlet, an outlet, and a passageway.

20 Claims, 14 Drawing Sheets

(56) References Cited

U.S. PATENT DOCUMENTS

| | | | | |
|---|---|---|---|---|
| 10,731,562 | B2 | 8/2020 | Porter et al. | |
| 10,731,855 | B2 | 8/2020 | Zelesky et al. | |
| 10,816,203 | B2 | 10/2020 | Jones et al. | |
| 11,136,891 | B2 | 10/2021 | Gossilin et al. | |
| 11,137,140 | B2 | 10/2021 | Mongillo, Jr. et al. | |
| 2005/0095542 | A1 | 5/2005 | Sanders | |
| 2010/0239409 | A1 | 9/2010 | Draper | |
| 2012/0017596 | A1* | 1/2012 | Rudrapatna | F23R 3/06 29/700 |
| 2013/0255265 | A1* | 10/2013 | Rudrapatna | F23R 3/16 29/889.22 |
| 2014/0219814 | A1 | 8/2014 | Haselhaus | |
| 2016/0201507 | A1 | 7/2016 | Bunker | |
| 2017/0370584 | A1 | 12/2017 | Boardman | |
| 2018/0274370 | A1 | 9/2018 | Bunker et al. | |
| 2019/0041059 | A1 | 2/2019 | Slavens et al. | |
| 2020/0166211 | A1 | 5/2020 | Dudebout et al. | |
| 2020/0208840 | A1 | 7/2020 | Sauer et al. | |

* cited by examiner

TURBINE ENGINE COMBUSTOR WITH A DILUTION PASSAGE

CROSS REFERENCE TO RELATED APPLICATION

This application is a continuation of U.S. patent application Ser. No. 18/187,773 filed Mar. 22, 2023, now U.S. Pat. No. 12,060,995, issued Aug. 13, 2024, which is incorporated herein in its entirety.

TECHNICAL FIELD

The present subject matter relates generally to a combustor for a turbine engine, and, more specifically, for a combustor with at least one dilution passage.

BACKGROUND

Turbine engines are driven by a flow of combustion gases passing through the engine to rotate a multitude of turbine blades, which, in turn, rotate a compressor to provide compressed air to the combustor for combustion. A combustor can be provided within the turbine engine and is fluidly coupled with a turbine into which the combusted gases flow.

The use of hydrocarbon fuels in the combustor of a turbine engine is known. Generally, air and fuel are fed to a combustion chamber, the air and fuel are mixed, and then the fuel is burned in the presence of the air to produce hot gas. The hot gas is then fed to a turbine where it cools and expands to produce power. By-products of the fuel combustion typically include environmentally unwanted byproducts, such as nitrogen oxide and nitrogen dioxide (collectively called $NO_x$), carbon monoxide (CO), unburned hydrocarbon (UHC) (e.g., methane and volatile organic compounds that contribute to the formation of atmospheric ozone), and other oxides, including oxides of sulfur (e.g., $SO_2$ and $SO_3$).

DETAILED DESCRIPTION

Figure 1:
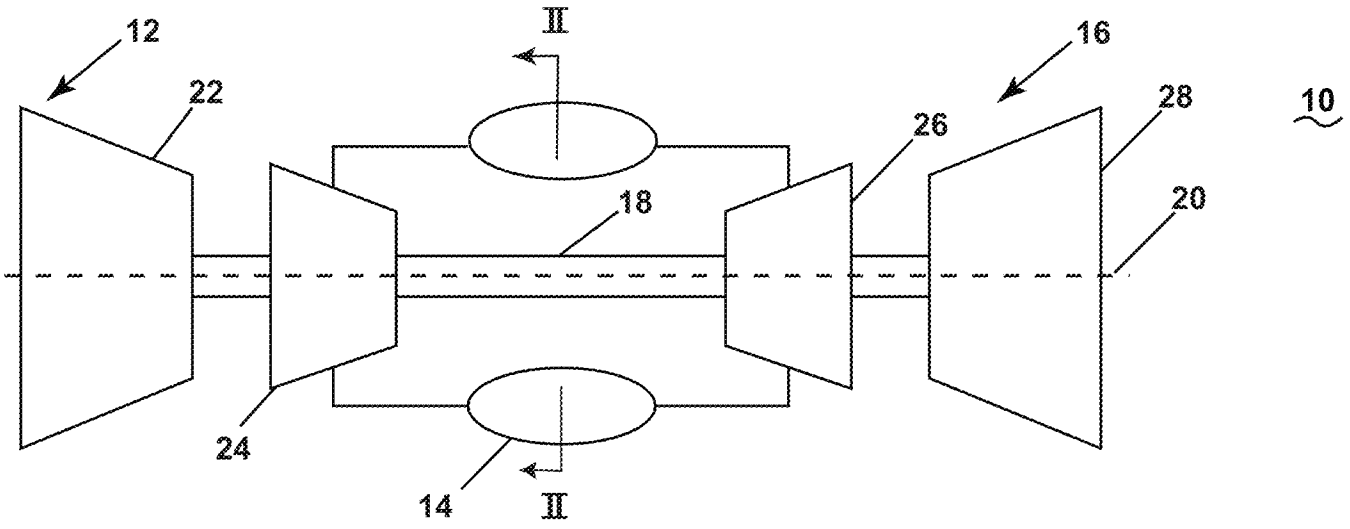
FIG. 1 is a schematic of a turbine engine.

Aspects of the disclosure described herein are directed to passages, apertures, or holes within a turbine engine through which an airflow passes. The aspects of the disclosure provide improved control of the airflow through the passage to reduce or prevent flow separation. While illustrated in the context of a combustor, other passages within the turbine engine are contemplated. The combustor includes a combustion chamber at least partially defined by a dome wall. A set of fuel cups are circumferentially arranged on the annular dome wall and fluidly coupled to the combustion chamber. A first set of dilution passages are provided around each fuel cup of the set of fuel cups. A second set of dilution passages are provided in a liner of the combustor. The first set of dilution passages or the second set of dilution passages, or both the first and second sets of dilution passages can include a radiused inlet. The radiused inlet has one or more portions having a non-zero radius of curvature. The radiused inlet is coupled to a passageway, having an outlet. The passageway fluidly couples compressed air from outside the combustor to inside the combustor.

A radiused groove or channel can form the radiused inlet and fluidly couple two or more passageways. Alternatively, in another and different non-limiting example, each passageway can have a corresponding radiused inlet, such as, for example, a spherical inlet.

Optionally, the radiused inlet can include or be adjacent to additional features that can include one or more of an aperture, differing or changing radii of curvature, a chamfer, or flow adjustors.

The radiused inlet or optional additional features reduce flow separation between the compressed air and the sides of the passageway. More specifically, the radiused inlet or optional additional features reduce flow separation between the compressed air and the sides of the passageway adjacent a passageway inlet.

For purposes of illustration, the present disclosure will be described with respect to a turbine engine (gas turbine engine). It will be understood, however, that aspects of the disclosure described herein are not so limited and that a combustor as described herein can be implemented in engines, including but not limited to turbojet, turboprop, turboshaft, and turbofan engines. Aspects of the disclosure discussed herein may have general applicability within non-aircraft engines having a combustor, such as other mobile applications and non-mobile industrial, commercial, and residential applications.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first" and "second" may be used interchangeably to distinguish one component from another and are not intended to signify location or importance of the individual components.

The terms "forward" and "aft" refer to relative positions within a turbine engine or vehicle, and refer to the normal operational attitude of the turbine engine or vehicle. For example, with regard to a turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The term "fluid communication" means that a fluid is capable of making the connection between the areas specified.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

As used herein, the term "radius of curvature" equals the radius of a circular arc which best approximates the curve at that point. A linear, or flat surface has a radius of curvature of zero. A curved surface, therefore, has a non-zero radius of curvature.

FIG. 1 is a schematic view of a turbine engine 10. As a non-limiting example, the turbine engine 10 can be used within an aircraft. The turbine engine 10 can include, at least, a compressor section 12, a combustion section 14, and a turbine section 16 in serial flow arrangement. A drive shaft 18 rotationally couples the compressor section 12 and the turbine section 16, such that rotation of one affects the rotation of the other, and defines a rotational axis or engine centerline 20 for the turbine engine 10.

The compressor section 12 can include a low-pressure (LP) compressor 22, and a high-pressure (HP) compressor 24 serially fluidly coupled to one another. The turbine section 16 can include an LP turbine 26, and an HP turbine 28 serially fluidly coupled to one another. The drive shaft 18 can operatively couple the LP compressor 22, the HP compressor 24, the LP turbine 26 and the HP turbine 28 together. Alternatively, the drive shaft 18 can include an LP drive shaft (not illustrated) and an HP drive shaft (not illustrated). The LP drive shaft can couple the LP compressor 22 to the LP turbine 26, and the HP drive shaft can couple the HP compressor 24 to the HP turbine 28. An LP spool can be defined as the combination of the LP compressor 22, the LP turbine 26, and the LP drive shaft such that the rotation of the LP turbine 26 can apply a driving force to the LP drive shaft, which in turn can rotate the LP compressor 22. An HP spool can be defined as the combination of the HP compressor 24, the HP turbine 28, and the HP drive shaft such that the rotation of the HP turbine 28 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about the turbine engine 10. It will be appreciated that the representation of the compressor section 12 is merely schematic and that there can be any number of stages. Further, it is contemplated, that there can be any other number of components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section 16 can be mounted to the casing in a circumferential manner. It is noted that there can be any number of blades, vanes and turbine stages as the illustrated turbine section is merely a schematic representation. Further, it is contemplated, that there can be any other number of components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 28 at a downstream end of the combustion section 14.

During operation of the turbine engine 10, ambient or atmospheric air is drawn into the compressor section 12 via a fan (not illustrated) upstream of the compressor section 12, where the air is compressed defining a pressurized air. The pressurized air can then flow into the combustion section 14 where the pressurized air is mixed with fuel and ignited, thereby generating combustion gases. Some work is extracted from these combustion gases by the HP turbine 28, which drives the HP compressor 24. The combustion gases are discharged into the LP turbine 26, which extracts additional work to drive the LP compressor 22, and the exhaust gas is ultimately discharged from the turbine engine 10 via an exhaust section (not illustrated) downstream of the turbine section 16. The driving of the LP turbine 26 drives the LP spool to rotate the fan (not illustrated) and the LP compressor 22. The pressurized airflow and the combustion gases can together define a working airflow that flows through the fan, compressor section 12, combustion section 14, and turbine section 16 of the turbine engine 10.

Figure 2:
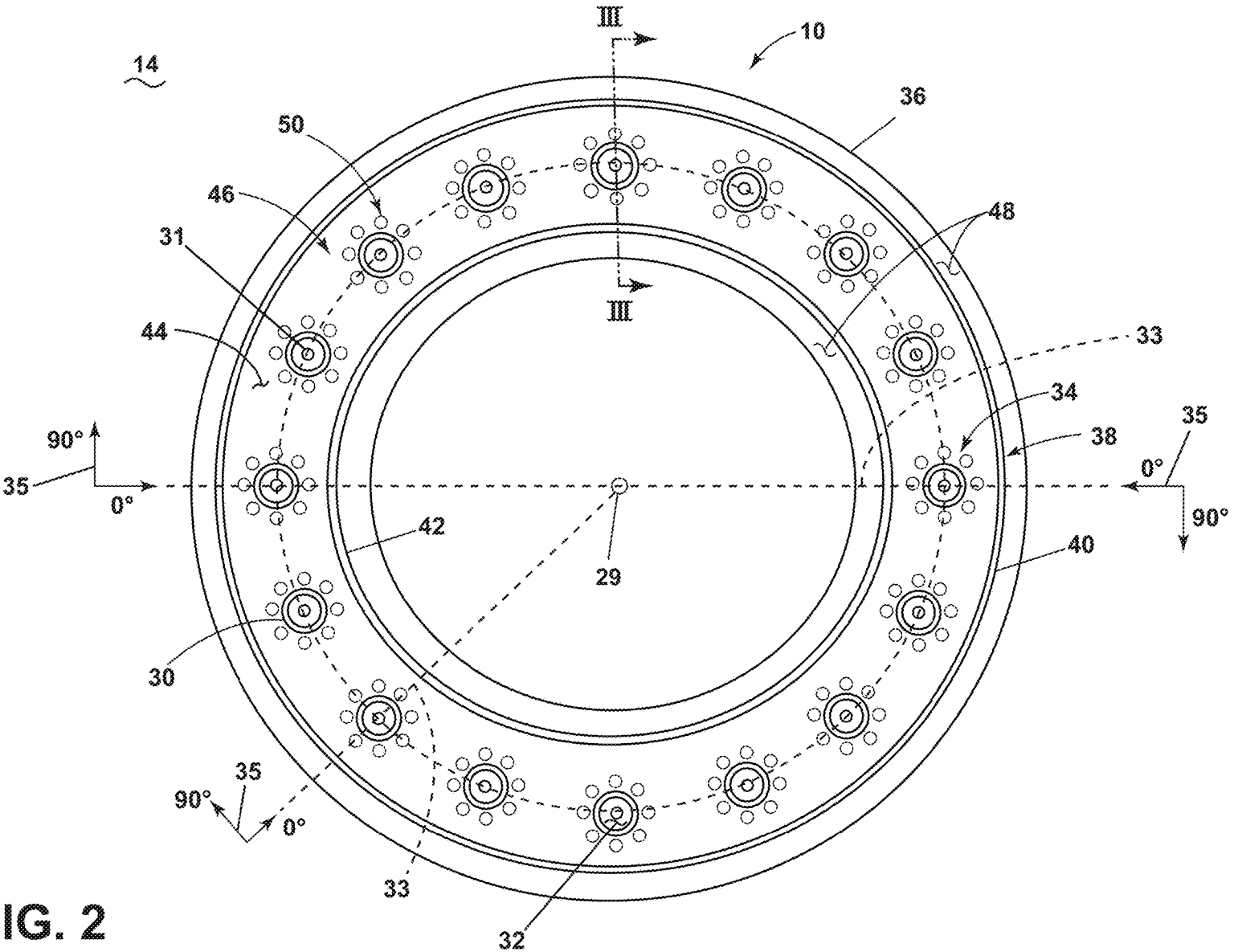
FIG. 2 depicts a cross-section view along line II-II of FIG. 1 of a combustion section of the turbine engine.

FIG. 2 depicts a cross-sectional view of the combustion section 14 along line II-II of FIG. 1. The combustion section 14 can include a set of fuel cups 32 annularly arranged about a combustor centerline 29. The combustor centerline 29 can be the engine centerline 20 of the turbine engine 10. Additionally, or alternatively, the combustor centerline 29 can be a centerline for the combustion section 14, a single combustor, or a set of combustors that are arranged about the combustor centerline 29.

The set of fuel cups 32 are arranged about the combustor centerline 29. A set of fuel injectors 30 define at least a portion of the set of fuel cups 32. The set of fuel cups 32 can include rich cups, lean cups, or a combination of both rich and lean cups annularly provided about the engine centerline. It should be appreciated that the annular arrangement of fuel injectors can be one or multiple fuel injectors and one or more of the fuel injectors 30 can have different characteristics. The combustor 34 is defined by a combustor liner 38. The combustor 34 can have a can, can-annular, or annular arrangement depending on the type of engine in which the combustor 34 is located. In a non-limiting example, the combustor 34 can have a combination arrangement as further described herein located within a casing 36 of the engine. The combustor liner 38, as illustrated by way of example, can be annular. The combustor liner 38 can include an outer combustor liner 40 and an inner combustor liner 42 concentric with respect to each other and annular about the engine centerline. The combustor liner 38 further defines the set of fuel cups 32. A dome wall 44 together with the combustor liner 38 can define a combustion chamber 46 annular about the engine centerline 20. The set of fuel cups 32 can be fluidly coupled to the combustion chamber 46. A compressed air passageway 48 can be defined at least in part by both the combustor liner 38 and the casing 36.

A first set of dilution passages 50 are illustrated, by way of example, as having an annular arrangement about each fuel cup of the set of fuel cups 32 or each fuel injector 30 of the set of fuel injectors 30. While illustrated as having an annular arrangement, any arrangement of the first set of dilution passages 50 is contemplated. Further, any number of dilution passages can be included in the first set of dilution passages 50, including a single dilution passage. The first set of dilution passages 50 are defined, at least in part, by the dome wall 44.

Each of the set of fuel cups 32 or the fuel injectors 30 can include a fuel cup centerline or a fuel injector centerline, illustrated as a fuel cup centerline 31. The fuel cup centerline 31, in combination with the combustor centerline 29, can be used to define a respective fuel cup reference line or a fuel injector reference line, illustrated as a fuel cup reference line 33 that extends radially from the combustor centerline 29 and through the corresponding fuel cup centerline 31. For the purposes of illustration, three fuel cup reference lines 33 are shown, however, it will be appreciated that each fuel injector 30 or each fuel cup 32 includes a corresponding fuel cup reference line. The fuel cup reference line 33 is used in this description to establish a local coordinate system 35 for each fuel cup 32. The local coordinate system defines a 0-180 degree line lying on the corresponding fuel cup reference line 33, and a 90-270 degree line for each of the three illustrated fuel cup reference lines 33. The 0 degree and 90 degree lines have been shown for convenience on each of the local coordinate systems 35. Since set of fuel cups 32 are circumferentially spaced around the combustor centerline or the engine centerline 20, the local coordinate systems 35 based on the fuel cup reference line 33 is a convenient way to describe a local fuel cup of the set of fuel cups 32, while taking into account rotational shifts in the local coordinate system 35 due to the circumferential arrangement.

Figure 3:
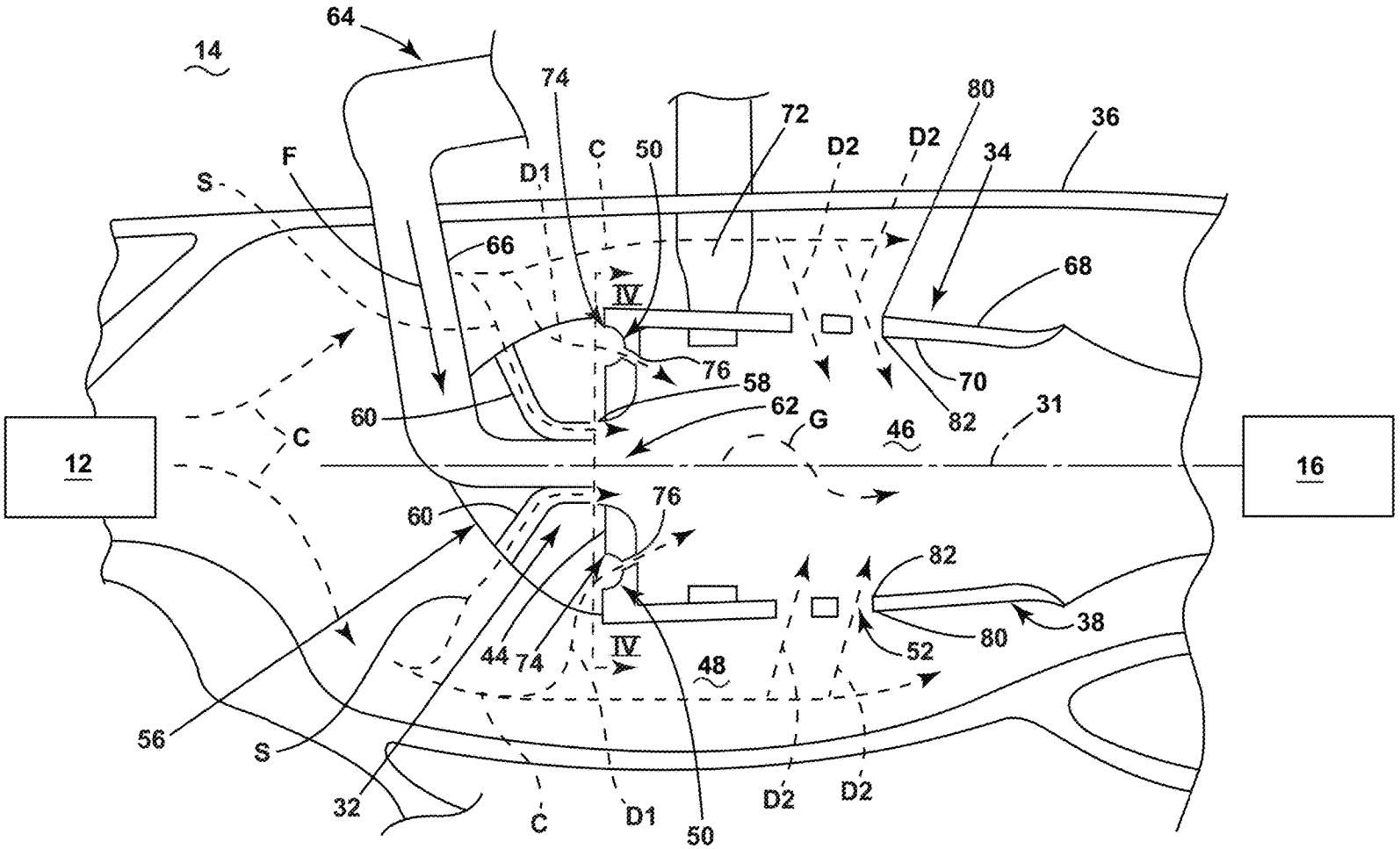
FIG. 3 is a schematic of a side cross-sectional view taken along line III-III of FIG. 2 of a combustor in the combustion section formed from a combustor liner having dilution passages according to an aspect of the disclosure herein.

FIG. 3 depicts a cross-section view taken along line III-III of FIG. 1 illustrating the combustion section 14. At least one dilution passage can fluidly connect compressed air and the combustion chamber 46. By way of example, the at least one dilution passage is illustrated as the first set of dilution passages 50 or a second set of dilution passages 52. The combustor 34 can include the first set of dilution passages 50, the second set of dilution passages 52, or both the first set of dilution passages 50 and the second set of dilution passages 52.

The first set of dilution passages 50 can pass through the dome wall 44, fluidly coupling compressed air from the compressor section 12 or the compressed air passageway 48 to the combustion chamber 46.

The second set of dilution passages 52 can pass through the combustor liner 38, fluidly coupling compressed air from the compressed air passageway 48 to the combustion chamber 46.

The fuel cup 32 can be coupled to and disposed within a dome assembly 56. The fuel cup 32 can include a flare cone 58 and a swirler 60. The flare cone 58 includes an outlet 62 of the fuel cup 32 directly fluidly coupled to the combustion chamber 46. The fuel cup 32 is fluidly coupled to a fuel inlet 64 via a passageway 66. The fuel cup centerline 31 can be defined by the fuel cup 32, the flare cone 58, or the outlet 62.

Both the inner combustor liner 42 and the outer combustor liner 40 can have an outer surface 68 and an inner surface 70 at least partially defining the combustion chamber 46. The combustor liner 38 can be made of one continuous monolithic portion or be multiple monolithic portions assembled together to define the inner combustor liner 42 and the outer combustor liner 40. By way of non-limiting example, the outer surface 68 can define a first piece of the combustor liner 38 while the inner surface 70 can define a second piece of the combustor liner 38 that when assembled together form the combustor liner 38. As described herein, the combustor liner 38 includes the second set of dilution passages 52. It is further contemplated that the combustor liner 38 can be any type of combustor liner 38, including but not limited to a single wall or a double walled liner or a tile liner. An ignitor 72 can be provided at the combustor liner 38 and fluidly coupled to the combustion chamber 46, at any location, by way of non-limiting example upstream of the second set of dilution passages 52.

During operation, a compressed air (C) from a compressed air source, such as the LP compressor 22 or the HP compressor 24 of FIG. 1, can flow from the compressor section 12 to the combustor 34. A portion of the compressed air (C) can flow through the dome assembly 56. A first part of the compressed air (C) flowing through the dome assembly 56 can be fed to the fuel cup 32 via the swirler 60 as a swirled airflow(S). A flow of fuel (F) is fed to the fuel cup 32 via the fuel inlet 64 and the passageway 66. The swirled airflow(S) and the flow of fuel (F) are mixed at the flare cone 58 and fed to the combustion chamber 46 as a fuel/air mixture. The ignitor 72 can ignite the fuel/air mixture to define a flame within the combustion chamber 46, which generates a combustion gas (G). While shown as starting axially downstream of the outlet 62, it will be appreciated that the fuel/air mixture can be ignited at or near the outlet 62.

A second part of the compressed air (C) flowing through one or more portions of the dome assembly 56 can be fed to the first set of dilution passages 50 as a first dilution airflow (D1). That is, a portion of the compressed air (C) from the compression section 12 can flow through the dome wall 44 and into the combustion chamber 46 by passing through the first set of dilution passages 50. A radiused inlet 74 is defined by a portion of one or more dilution passages of the first set of dilution passages 50. The radiused inlet 74 is fluidly coupled to the compressed air (C). The first dilution airflow (D1) enters the one or more dilution passages of the first set of dilution passages 50 at the radiused inlet 74 and exits the one or more dilution passages of the first set of dilution passages 50 at an outlet 76 located at the dome wall 44.

Another portion of the compressed air (C) can flow through the compressed air passageway 48 and can be fed to the second set of dilution massages 52 as a second dilution airflow (D2). In other words, another portion of the compressed air (C) can flow axially past the dome assembly 56 and enter the combustion chamber 46 by passing through the second set of dilution passages 52. That is, compressed air (C) can flow through the combustor liner 38 and into the combustion chamber 46 by passing through the second set of dilution passages 52.

An inlet 80 is defined by a portion of one or more dilution passages of the second set of dilution passages 52. The inlet 80 is fluidly coupled to the compressed air (C). The inlet 80 can be a radiused inlet. That is, the inlet 80 can be curved or contoured. The second dilution airflow (D2) enters the one or more dilution passages of the second set of dilution passages 52 at the inlet 80 and exits the one or more dilution passages of the second set of dilution passages 52 at an outlet 82 located at the inner surface 70 of the combustor liner 34.

The first dilution airflow (D1) can be used to direct and shape the flame. The second dilution airflow (D2) can be used to direct the combustion gas (G). In other words, the first set of dilution passages 50 or the second set of dilution passages 52 extending through the dome wall 44 or the combustor liner 38 direct air into the combustion chamber 46, where the directed air is used to control, shape, cool, or otherwise contribute to the combustion process in the combustion chamber 46.

The combustor 34 shown in FIG. 3 is well suited for the use of a hydrogen-containing gas as the fuel because it helps contain the faster moving flame front associated with hydrogen fuel, as compared to traditional hydrocarbon fuels. However, the combustor 34 can be used with traditional hydrocarbon fuels.

Figure 4:
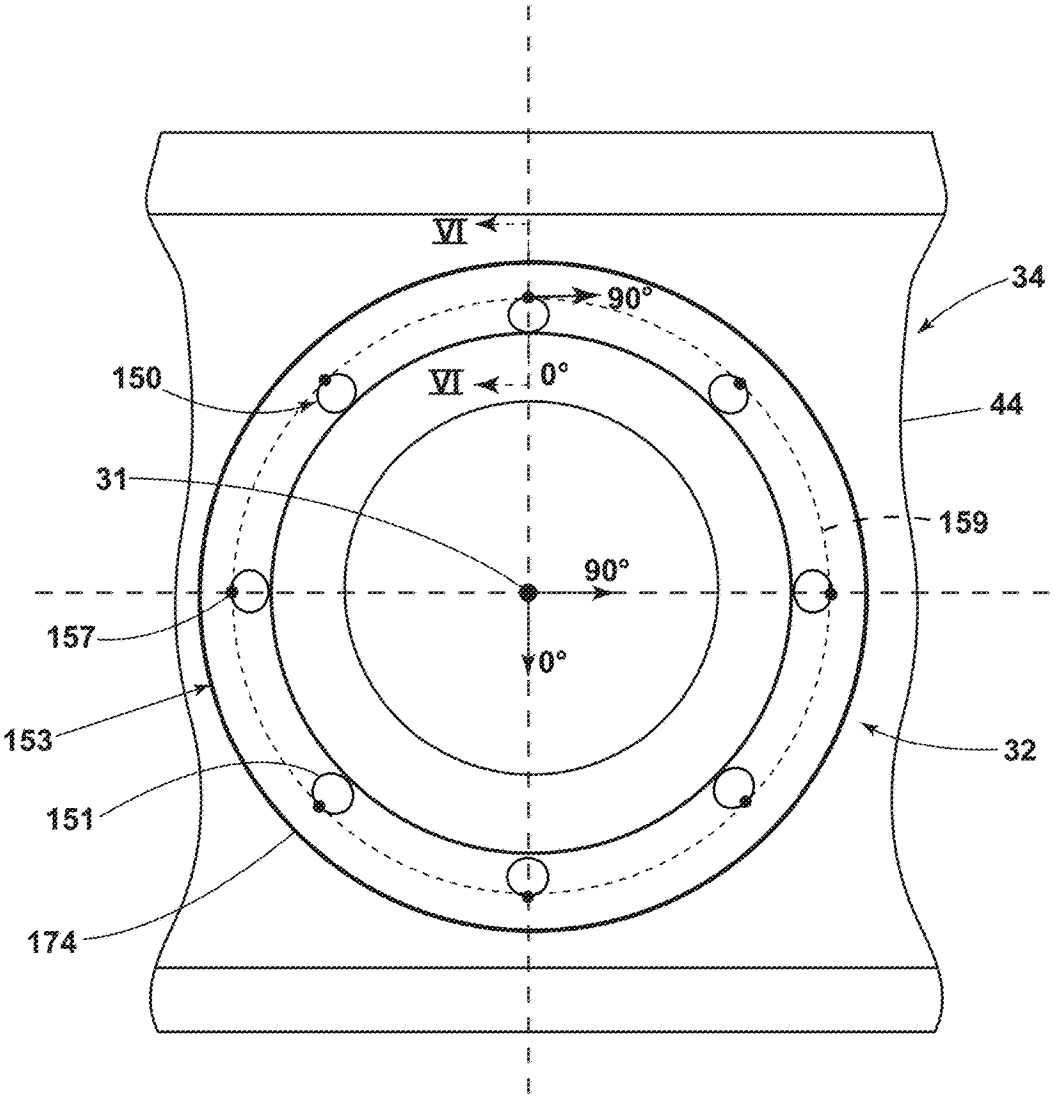
FIG. 4 is a schematic, transverse cross-sectional view taken along line IV-IV of FIG. 3 of an arrangement of a set of dilution passages provided on a dome wall suitable for use within the combustor of FIG. 3.

FIG. 4 is a schematic, transverse, cross-sectional view of a first set of dilution passages 150 on a dome wall 44 suitable for use within the combustor 34 of FIG. 3. Therefore, similar parts of the first set of dilution passages 150 and the first set of dilution passages 50 will be given similar names, with it being understood that the description of similar parts of the first set of dilution passages 50 and the combustor 34 applies to the first set of dilution passages 150, unless indicated otherwise. The first set of dilution passages 150 is provided on the dome wall 44 around the set of fuel cups 32 having the fuel cup centerline 31.

At least one dilution passage of the first set of dilution passages 150 includes a radiused inlet 174 and a passageway 151 fluidly coupled to the radiused inlet 174. The radiused inlet 174 receives compressed air (C) (FIG. 3) which then flows into the passageway 151.

Alternatively, in another different and non-limiting example, the first set of dilution passages 150 can include a subset of dilution passages of the first set of dilution passages 150 wherein each dilution passage of the subset of dilution passages includes the radiused inlet 174. Another subset of dilution passages of the first set of dilution passages 150 can be linear or otherwise not include a radiused inlet. The another subset of dilution passages of the first set of dilution passages 150 that do not have a radiused inlet can be passages that extend through the dome wall 44. That is, not all of the dilution passages of the first set of dilution passages 150 are required to have a radiused inlet.

A channel 153 can extend circumferentially between at least two radiused inlets 174. However, it is contemplated that the channel 153 can span more than two radiused inlets 174. As illustrated, by way of example, the channel 153 can span all the radiused inlets 174 of the first set of dilution passages 150. That is, the channel 153 can circumferentially fluidly connect the radiused inlets 174 of the first set of dilution passages 150. In other words, the channel 153 can be a radiused recessed region, groove mill, or curved groove in the dome wall 44 defining the radiused inlets 174 of the first set of dilution passages 150.

Each radiused inlet 174 has an inlet centerline 157. The inlet centerline 157 can be parallel to and in the same direction as the fuel cup centerline 31. The inlet centerline 157 can be perpendicular to a channel centerline 159 that can circumscribe the fuel cup 32. However, in a different and non-limiting example, the inlet centerline 157 and the fuel cup centerline 31 or the engine centerline 20 (FIG. 1) can be at any angle.

Figure 5:
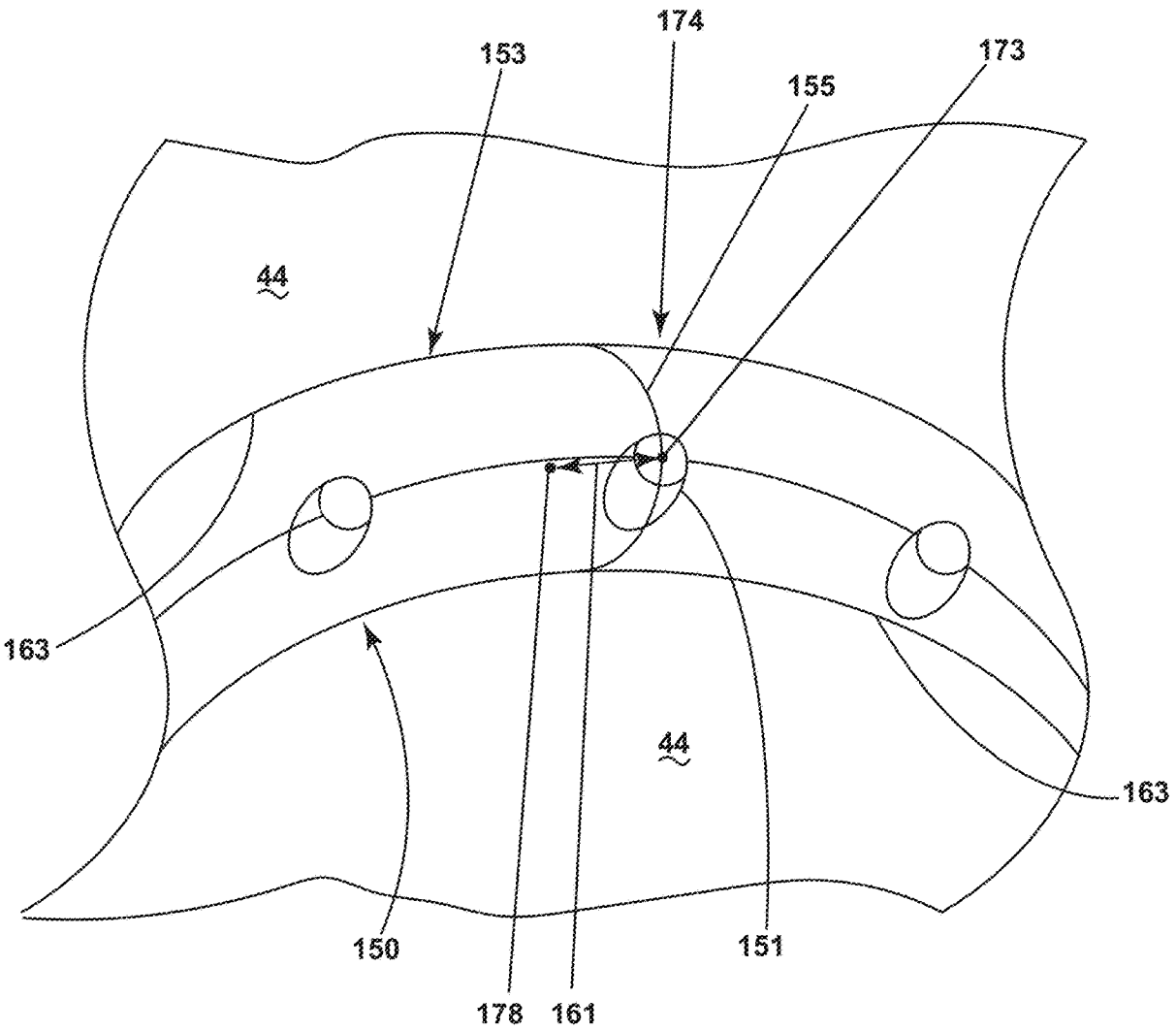
FIG. 5 is a schematic partial perspective view of the set of dilution passages of FIG. 4.

FIG. 5 is a schematic perspective of a portion of the first set of dilution passages 150 having the channel 153. The channel 153 is illustrated, by way of example, as a curved recessed into the dome wall 44 that fluidly couples at least two passageways 151.

The channel 153 can include a radiused sidewall 155. The radiused sidewall 155 can define one or more of the radiused inlets 174. That is, the channel 153 with the radiused sidewall 155 can span multiple radiused inlets 174.

The radiused sidewall 155 is curved and has a non-zero radius of curvature 161 measured from an arc point 173 to a center 178 of a circle of best fit. That is, the radiused sidewall 155 can be a radiused recess region defined by an exterior surface 163 of the dome wall 44. While illustrated as a linear or flat surface, the exterior surface 163 can be curved.

Figure 6:
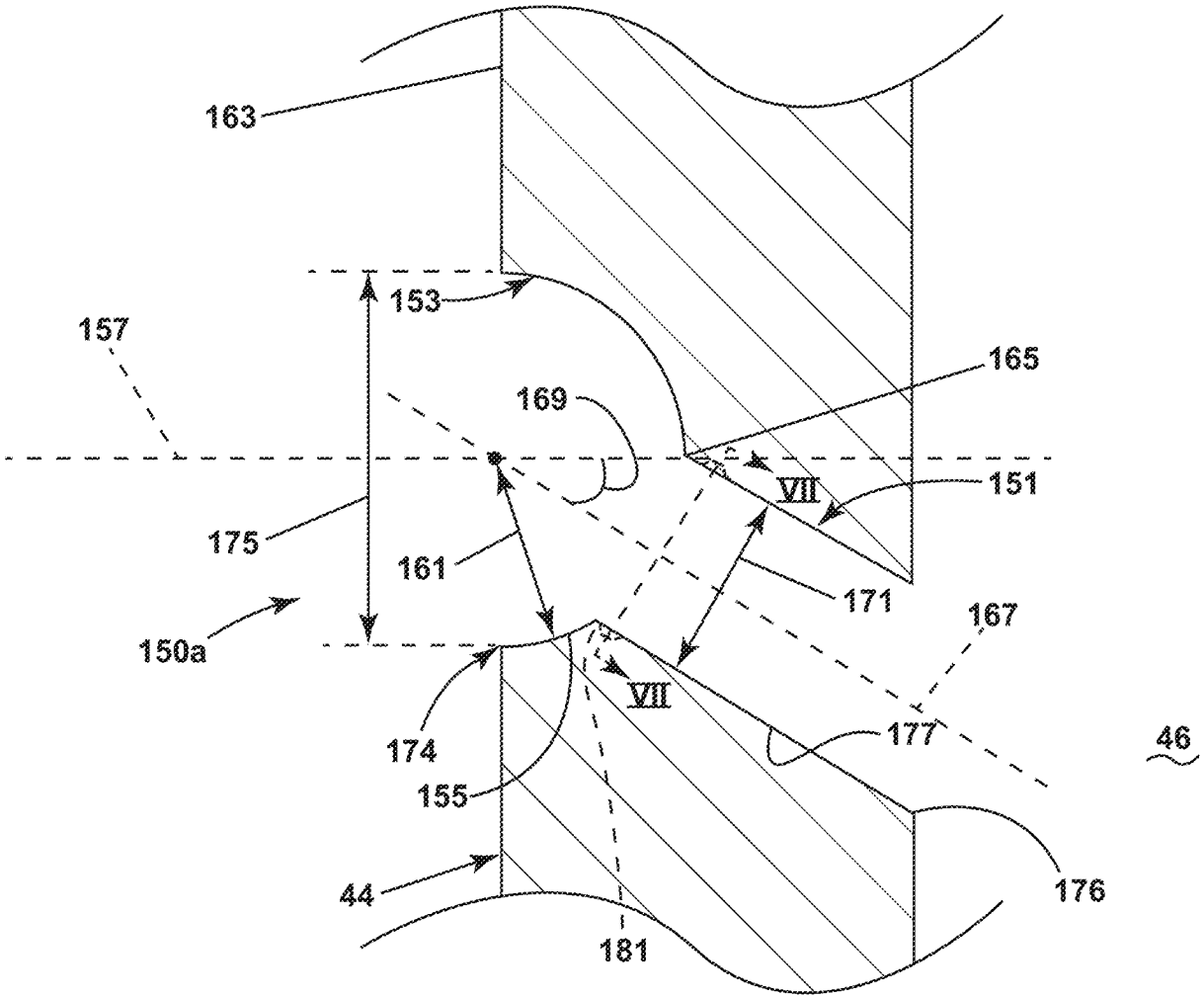
FIG. 6 is a cross-sectional view of a dilution passage of the set of dilution passages of FIG. 4 taken along the line VI-VI.

FIG. 6 is a schematic, cross-sectional view along the VI-VI line of FIG. 4, further illustrating a dilution passage 150*a* of the first set of dilution passages 150 (FIG. 4). The dilution passage 150*a* includes the radiused inlet 174 defined by the radiused sidewall 155 of the channel 153. The passageway 151 fluidly couples to the radiused inlet 174 at a passageway inlet 165. The channel 153 (FIG. 5) can span at least two passageway inlets 165. That is, the channel 153 (FIG. 5) can fluidly couple at least two passageway inlets 165.

A passageway centerline 167 can be defined by the passageway 151. A passageway angle 169 is defined between the passageway centerline 167 and the inlet centerline 157. The passageway angle 169 can be greater than 10° and less than 350°. More specifically, the passageway angle 169 can be equal to or greater than 30° and equal to or less than 80°, or equal to or greater than 280° and less than 330°.

A passageway diameter 171 is measured across the passageway 151. The passageway diameter 171 can be measured perpendicular to the passageway centerline 167. While illustrated as remaining the same, it is contemplated that the passageway diameter 171 can increase or decrease between the passageway inlet 165 and an outlet 176. While illustrated as a circle, the cross-section of the passageway 151 can be an oval, ellipse, regular polygon, irregular polygon, or any combination thereof. It is contemplated that the passageway diameter 171 can be an average cross-section distance taken along the length of the passageway 151.

Optionally, a sidewall 177 of the passageway 151 can include at least one flow adjustor 181. While illustrated as a recess extending away from the passageway centerline 167, the flow adjustor 181 can be a protrusion extending or protruding towards the passageway centerline 167. The flow adjustor 181 can be adjacent the passageway inlet 165. That is, the flow adjustor 181 can be a distance from the passageway inlet 165 that is less than three times the passageway diameter 171 or less than 70% of the distance between the passageway inlet 165 and the outlet 176 measured along the passageway centerline 167 or the sidewall 177.

A radiused inlet diameter 175 can be measured across the radiused inlet 174. While illustrated as a semi-circle, the cross section of the channel 153 or the radiused inlet 174 can be any shape having at least a portion having a non-zero radius of curvature.

The radiused inlet diameter 175 is illustrated, by way of example, as twice the radius of curvature 161. The radius of curvature 161 is the radius of curvature of the radiused inlet 174 or the radiused sidewall 155 of the channel 153. Alternatively, the radiused inlet diameter 175 can be twice the radius of curvature of any curved portion of the radiused inlet 174 or the radiused sidewall 155 of the channel 153. While illustrated at the intersection of the passageway centerline 167 and the inlet centerline 157, the center point for the radius of curvature 161 can be at other locations.

The ratio of the radiused inlet diameter 175 to the passageway diameter 171 is greater than 1. More specifically, the ratio of the radiused inlet diameter 175 to the passageway diameter 171 is greater than or equal to 1.1 and less than or equal to 6.0. In other words, the radiused inlet diameter 175 is greater than the passageway diameter 171.

The outlet 176, similar to the outlet 76 (FIG. 3), fluidly couples the passageway 151 to the combustion chamber 46.

The dilution passage 150*a* is illustrated, by way of example, as having the radiused inlet 174 and the passageway 151. The passageway 151 is fluidly coupled to the radiused inlet 174 at the passageway inlet 165 and fluidly coupled to the combustion chamber 46 at the outlet 176. Alternatively, in another different and non-limiting example, the dilution passage 150*a* can include the radiused inlet 174 without a passageway. That is, the radiused inlet 174 can fluidly couple to the combustion chamber 46 at the passageway inlet 165, functioning as an outlet.

Referencing FIG. 3-6, in operation, the compressed air (C) is provided to the channel 153. The compressed air (C) passes through the radiused inlets 174 and into the passageway 151 at the passageway inlet 165. Fluid connection of multiple passageways 151 by the channel 153 can equalize pressure of the compressed air (C) across the multiple passageways 151. The radiused inlets 174 can energize the compressed air (C) flow, resulting the airflow sticking to the sidewall 177 of the passageway 151. This reduces flow separation, especially in regions of the passageway 151 adjacent the passageway inlet 165.

The first dilution airflow (D1) or the second dilution airflow (D2) formed from passing through the first set of dilution passages 50, 150 or the second set of dilution passages 52, respectively, can then enter the combustion chamber 46.

While the channel 153 is illustrated at the exterior surface 163 of the dome wall 44, it is contemplated that the channel 153 can be a recessed portion or curved circumferential groove (not shown) in the combustor liner 38 (FIG. 3). Specifically, the channel 153 can be located at the outer surface 68 (FIG. 3) of the combustor liner 38 (FIG. 3). The channel 153 can fluidly couple two or more inlets 80 (FIG. 3) that are radiused inlets of the second set of dilution passages 52 (FIG. 3). The second set of dilution passages 52 (FIG. 3) can be more than one row of dilutions passages or dilution holes. Further, the second set of dilution passages 52 (FIG. 3) can vary in shape between holes in the second set of dilution passages 52 (FIG. 3).

The channel 153 can extend axially along the fuel cup centerline 31 (FIG. 3) between the radiused inlets of the second set of dilution passages 52 (FIG. 3). Additionally, or alternatively, in a different and non-limiting example, the channel 153 can be a radius recess (not shown) in the combustor liner 38 (FIG. 3) that extends circumferentially around the fuel cup centerline 31 (FIG. 3), fluidly coupling the radiused inlets 80 of the second set of dilution passages 52 (FIG. 3) along the outer surface 68 (FIG. 3) of the combustor liner 38 (FIG. 3). Optionally, the channel 153 can axially extend to fluidly couple multiple rows of dilution passages or dilution holes.

The channel 153, when located in the combustor liner 38 (FIG. 3) can receive the second dilution airflow (D2) (FIG. 3) at the radiused inlet 80 of the second set of dilution passages 52 (FIG. 3). The second dilution airflow (D2) (FIG. 3) can flow through a set of passageways that fluidly couple the radiused inlets 80 and the outlets 82 of the second set of dilution passages 52 (FIG. 3) with the combustion chamber 46 (FIG. 3).

Figure 7:
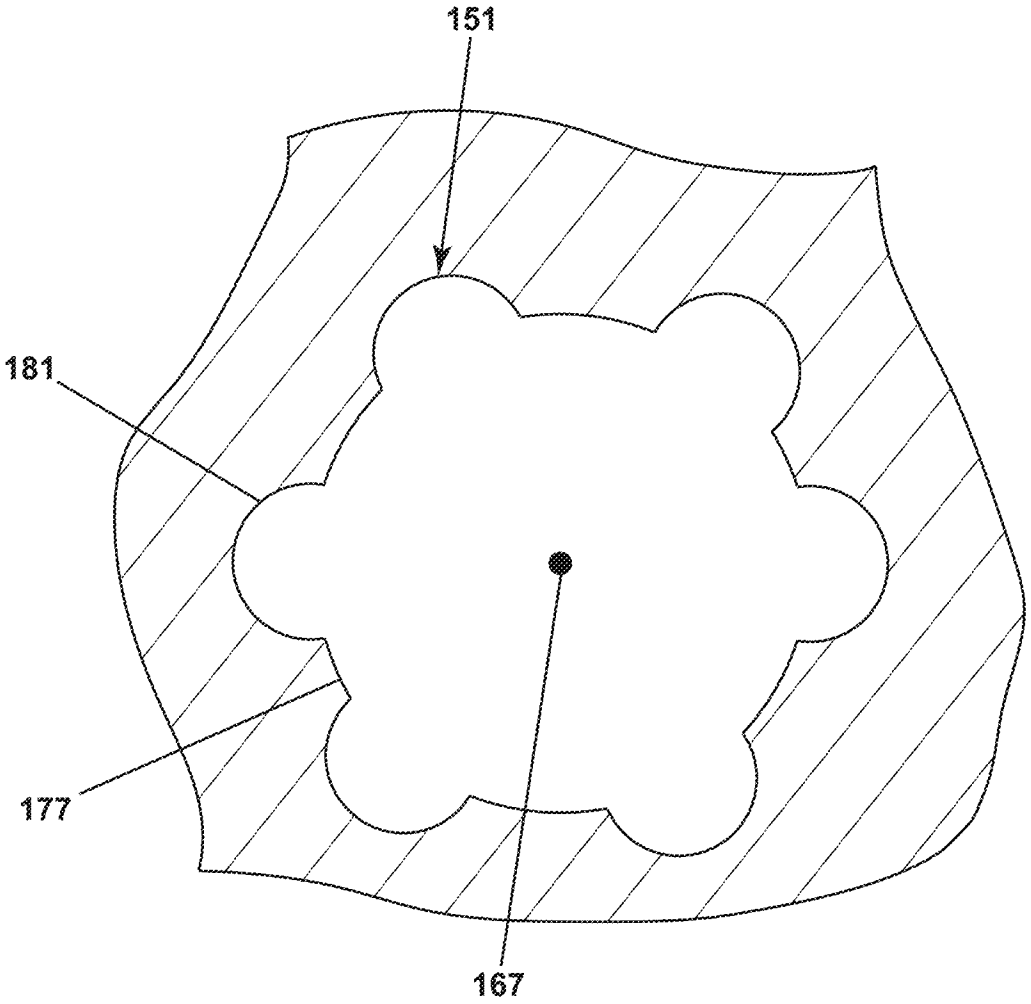
FIG. 7 is a cross-sectional view of a passage inlet of the dilution passages of FIG. 6 taken along the line VII-VII.

FIG. 7 is a cross section of the passageway 151 taken along line VII-VII of FIG. 7 showing the flow adjustor 181. The flow adjustor 181 can be, by way of example, a plurality of flow adjustors 181. The plurality of flow adjustors 181 can be uniformly distributed about the circumference of the passageway 151. Alternatively, in another different and non-limiting example the plurality of flow adjustors 181 can be non-uniformly distributed about the circumference of the passageway 151.

The flow adjustor 181 can recess into the sidewall 177 away from the passageway centerline 167, as illustrated, or protrude from the sidewall 177 toward the passageway centerline 167. The cross section of the flow adjustor 181 can be a semi-circle, a circle, an oval, an ellipse, a regular polygon, an irregular polygon, or any combination thereof.

While illustrated as uniform in shape and size, it is contemplated that one or more of the flow adjustors 181 can vary in shape or size from the other flow adjustors of the plurality of flow adjustors 181. It is contemplated that a subset of the flow adjustors 181 can protrude from the sidewall 177 while another subset of the flow adjustors 181 can recess into the sidewall 177.

Figure 8:
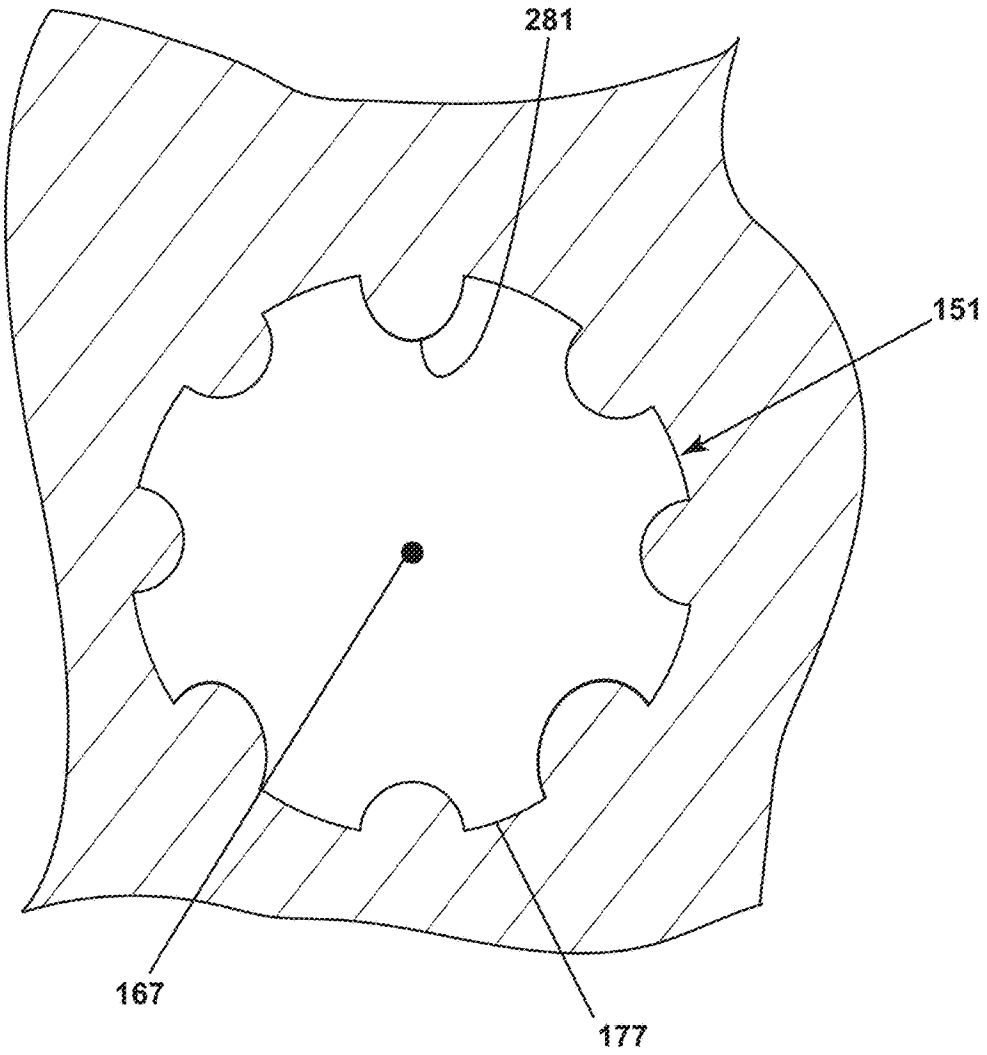
FIG. 8 is a variation of the cross-sectional view of FIG. 7.

FIG. 8 illustrates at least one flow adjustor 281 that is a variation of the flow adjustor 181 of FIG. 7. The flow adjustor 281 can be, by way of example, a plurality of flow adjustors 281. The plurality of flow adjustors 281 can be uniformly distributed about the circumference of the passageway 151.

The flow adjustor 281 can protrude from the sidewall 177, as illustrated, or recess into the sidewall 177. The cross section of the flow adjustor 281 can have, as illustrated by way of example, a semi-circular shape. However, it is contemplated that the cross section can be one or more parts or combination of shapes such as an oval, ellipse, airfoil, rectangle, triangle, irregular polygon, regular polygon.

As illustrated by way of example, the shape and size of the flow adjustor 281 can change from one flow adjustor 281 to another. Alternatively, in another different and non-limiting example, the flow adjustors 281 can be uniform in shape, size, or surface area.

Any number of protrusions or recesses at the sidewall 177 are contemplated between the passageway inlet 165 (FIG. 5) and the outlet 176 (FIG. 5).

Figure 9:
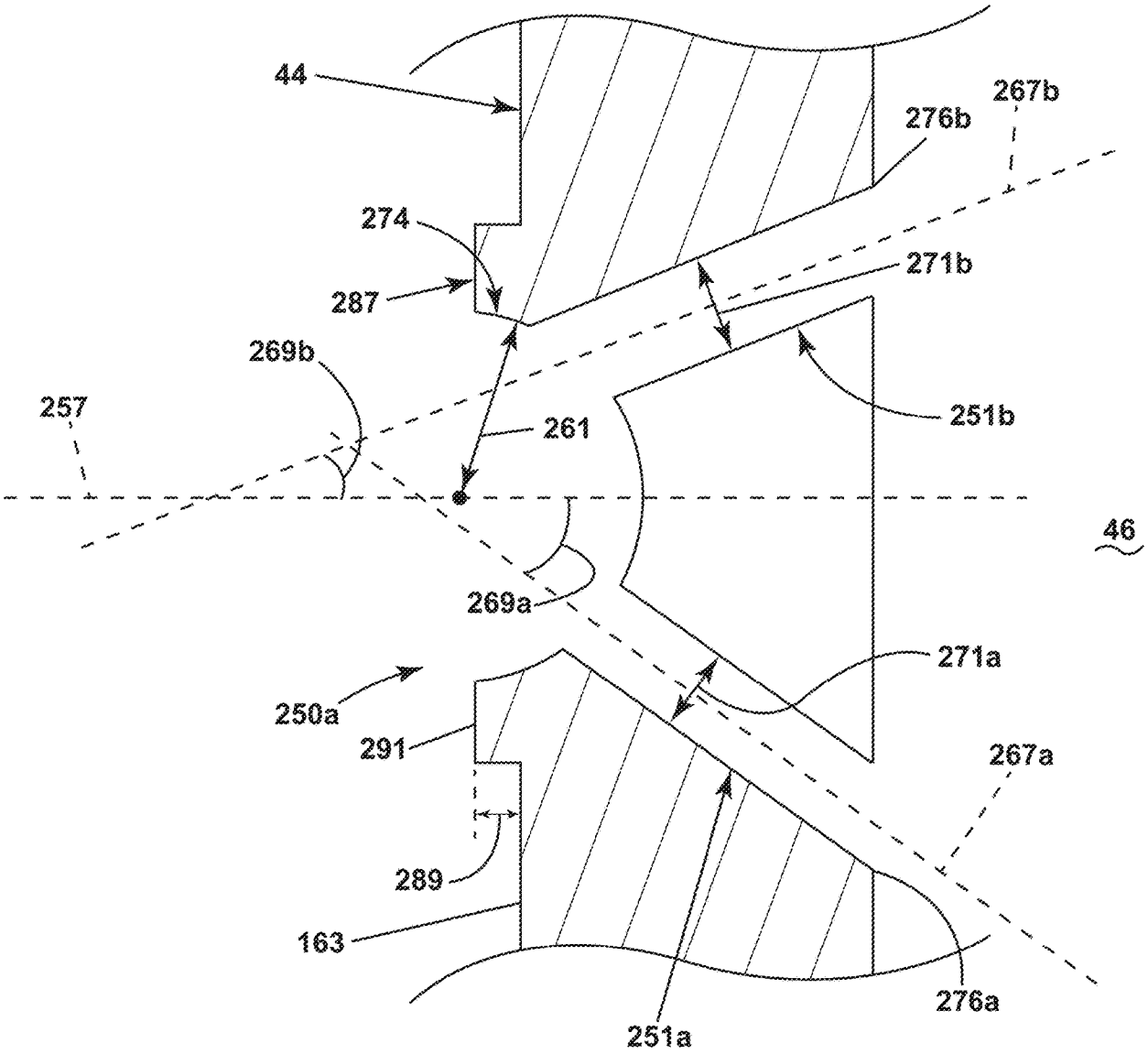
FIG. 9 is variation of the cross-sectional view FIG. 6.

FIG. 9 illustrates a dilution passage 250*a* of a first set of dilution passages similar to the dilution passage 150*a* of FIG. 6 of the first set of dilution passages 150 of FIG. 4, therefore, like parts will be identified with like numerals increased by 100, with it being understood that the description of the like parts of the first set of dilution passages 150 or dilution passage 150*a* applies to the dilution passage 250*a* unless otherwise noted.

The dilution passage 250*a* is illustrated, by way of example, as passing through the dome wall 44. It is contemplated that the dilution passage 250*a* can be part of the first set of dilution passages 50, 150 (FIG. 4 and FIG. 5) or the second set of dilution passages 52 (FIG. 3). That is, the dilution passage 250*a* can pass through the dome wall 44 or the combustor liner 38 (FIG. 3).

The dilution passage 250*a* includes a radiused inlet 274. The dilution passage 250*a* can include a plurality of passageways, illustrated, by way of example, as a first passageway 251*a* and a second passageway 251*b*. A first passageway centerline 267*a* is defined the first passageway 251*a*. A second passageway centerline 267*b* is defined by the second passageway 251*b*. The radiused inlet 274 can be fluidly connected to the first passageway 251*a* and the second passageway 251*b*. Outlets 276*a*, 276*b* are located downstream of the radiused inlet 274 and fluidly couple the first passageway 251*a* and the second passageway 251*b* to the combustion chamber 46.

The first passageway 251*a* has a first passageway diameter 271*a*. The second passageway 251*b* has a second passageway diameter 271*b* that can be greater than, less than, or equal to the first passageway diameter 271*a*.

A first passageway angle 269*a* is defined between the first passageway centerline 267*a* and an inlet centerline 257. A second passageway angle 269*b* is defined between the second passageway centerline 267*b* and the inlet centerline 257. The first passageway angle 269*a* or the second passageway angle 269*b* can have a measure that is between −90° and +90°. While illustrated as intersecting and having a defined or non-zero angle between the first passageway centerline 267*a* or the second passageway centerline 267*b* and the inlet centerline 257, it is contemplated in a different and non-limiting example, that the first passageway centerline 267*a* or the second passageway centerline 267*b* and the inlet centerline 257 can be parallel or non-intersecting.

An inlet boss or raised inlet portion 287 can at least partially define the radiused inlet 274. The raised inlet portion 287 can extend from the exterior surface 163 of the dome wall 44. A boss distance 289 can be measured from the exterior surface 163 of the dome wall 44 to an outermost extent 291 of the raised inlet portion 287. The boss distance 289 can be greater than 1% of a radius of curvature 261 and less than 200% of the radius of curvature 261. While the radius of curvature 261 is illustrated as having a center point in the plane of the outermost extent 291 of the raised inlet portion 287 of the dome wall 44, it is contemplated, in a different and non-limiting example, that the center point of the radius of curvature 261 can be located outside or not in the plane of the exterior surface 163 of the dome wall 44.

Figure 10:
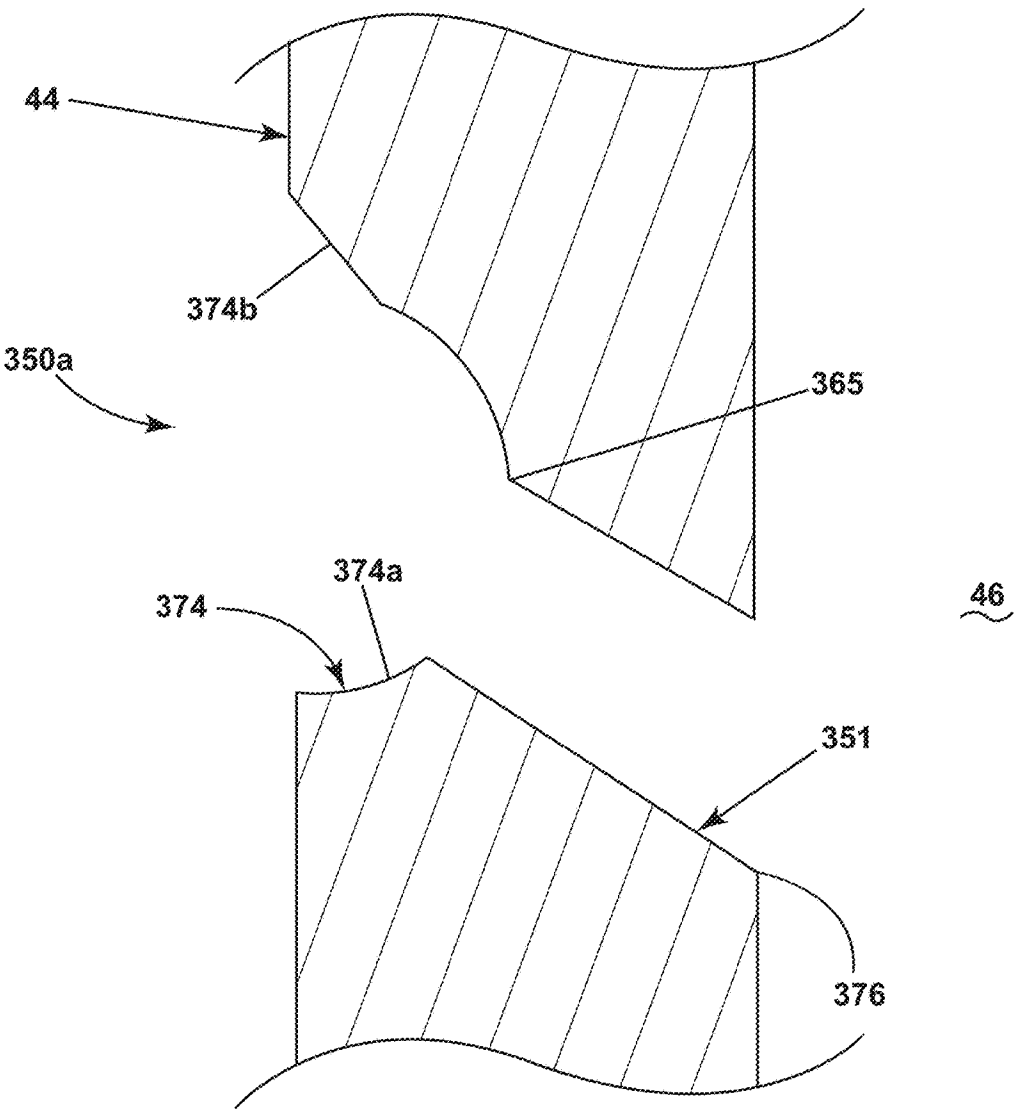
FIG. 10 is another variation of the cross-sectional view FIG. 6.

FIG. 10 illustrates a dilution passage 350*a* of a first set of dilution passages. The dilution passage 350*a* is similar to the dilution passages 150*a*, 250*a* therefore, like parts will be identified with like numerals further increased by 100, with it being understood that the description of the like parts of the dilution passages 150*a*, 250*a* applies to the dilution passage 350*a* unless otherwise noted. The dilution passage 350*a* is illustrated, by way of example, as passing through the dome wall 44. It is contemplated that the dilution passage 350*a* can be part of the second set of dilution passages 52 (FIG. 3). That is, the dilution passage 350*a* can pass through the dome wall 44 or the combustor liner 38 (FIG. 3).

The dilution passage 350*a* includes a radiused inlet 374. The radiused inlet 374 can have one or more portions, wherein at least one portion is a curved or radiused portion 374*a*. The radiused portion 374*a* can at least partially define a passageway inlet 365 to a passageway 351. The radiused inlet 374 can further include a non-radiused or linear portion 374*b*. As illustrated, by way of example, the linear portion 374*b* can be a chamfer.

An outlet 376, located downstream of the radiused inlet 374, fluidly couples the passageway 351 to the combustion chamber 46.

It is contemplated that the radiused inlet 374 can include more than one radiused portion 374*a*, wherein additional radiused portions can have respective radii of curvature that can be the same measurement or have a different measurement.

Figure 11:
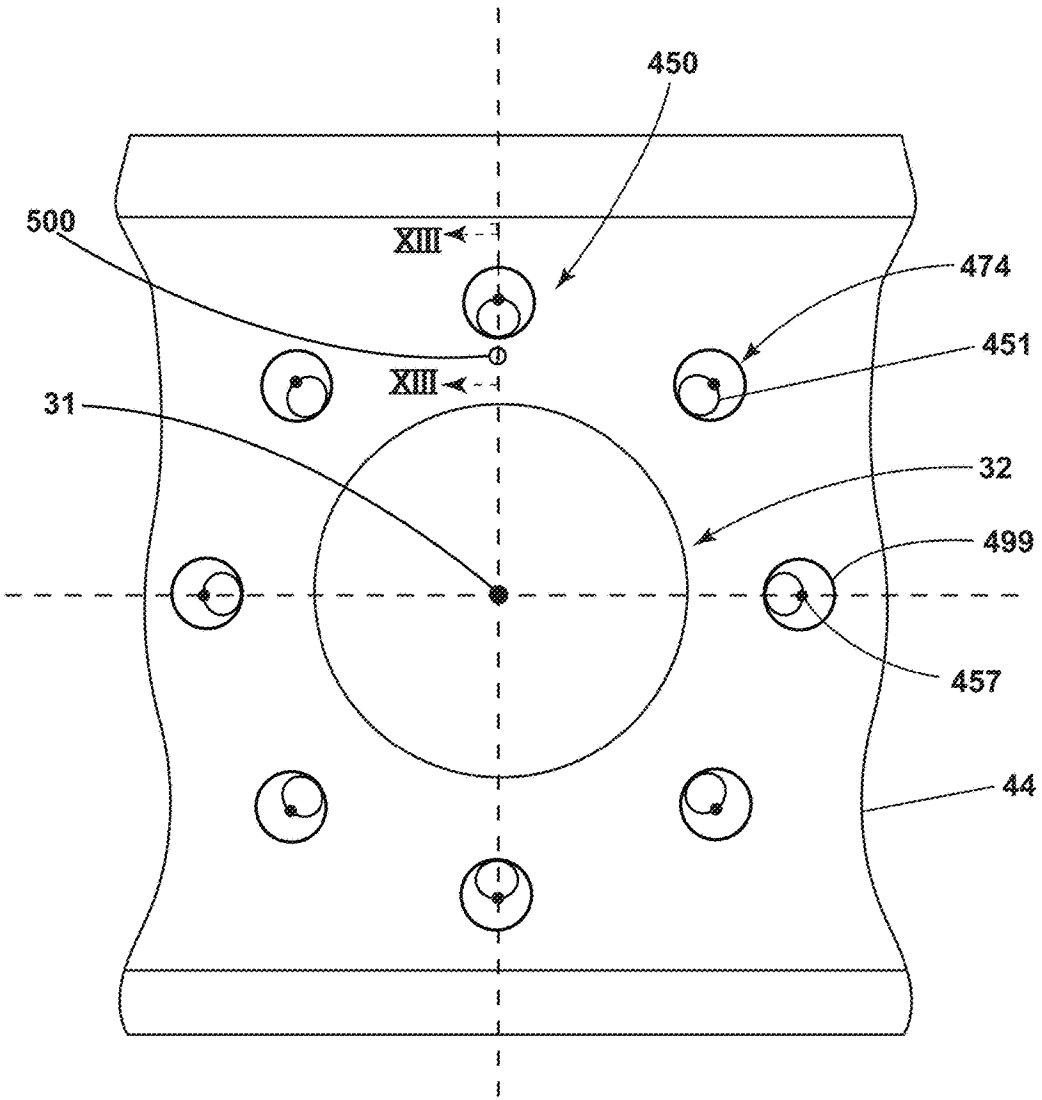
FIG. 11 is a variation of the schematic, transverse cross-sectional view of FIG. 4.

FIG. 11 is a variation of the schematic, transverse cross-sectional view of FIG. 4. That is, FIG. 11 is a schematic, transverse, cross-sectional view of a first set of dilution passages 450 on a dome wall 44 suitable for use within the combustor 34 of FIG. 3.

Therefore, similar parts of the first set of dilution passages 450 and the first set of dilution passages 50 will be given similar names, with it being understood that the description of similar parts of the first set of dilution passages 50 and the combustor 34 applies to the first set of dilution passages 450, unless indicated otherwise. The first set of dilution passages 450 is provided on the dome wall 44 around the set of fuel cups 32 having the fuel cup centerline 31.

At least one dilution passage of the first set of dilution passages 450 includes a radiused inlet 474 and a passageway 451 fluidly coupled to the radiused inlet 474. The radiused inlet 474 receives compressed air (C) (FIG. 3) which then flows into the passageway 451.

A ball mill or a spherical inlet 499 defines each of the radiused inlets 474. Each radiused inlet 474 has an inlet centerline 457. The inlet centerline 457 can be parallel to and in the same direction as the fuel cup centerline 31.

Optionally, an aperture 500 can fluidly connect compressed air to the passageway 451. While illustrated as a single aperture, the aperture 500 can be a plurality of apertures. It is contemplated that the aperture 500 or the plurality of apertures can be located at any position relative to the radiused inlet 474.

While illustrated as adjacent a single dilution hole, it is contemplated that any number (including zero) apertures can be located adjacent each dilution hole of the first set of dilution passages 450.

Figure 12:
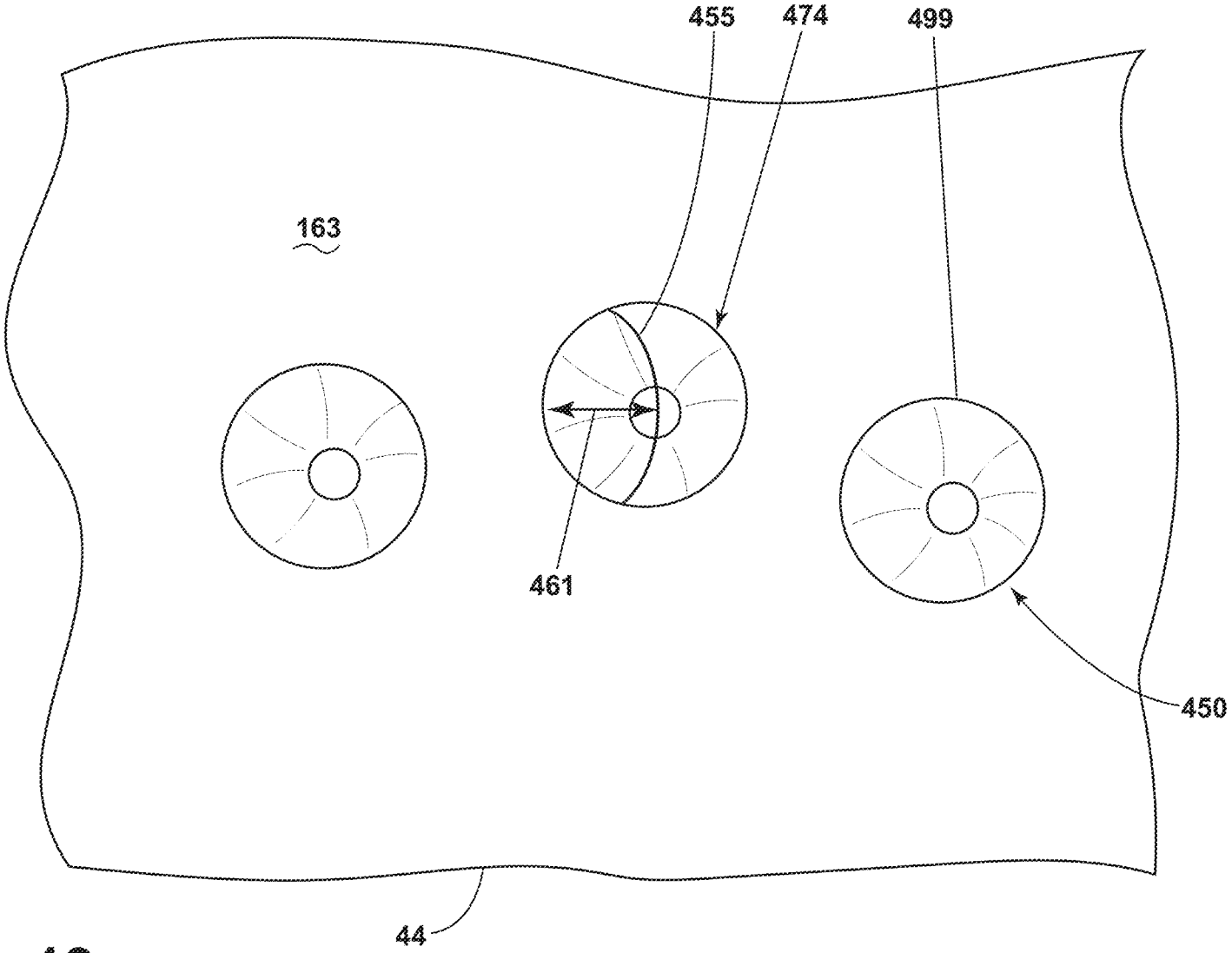
FIG. 12 is a schematic partial perspective view of the set of dilution passages of FIG. 11.

FIG. 12 is a schematic perspective of a portion of the first set of dilution passages 450 having the spherical inlet 499. The spherical inlet 499 can include a radiused sidewall 455. The radiused sidewall 455 can define one or more of the radiused inlets 474.

The radiused sidewall 455 has a radius of curvature 461 measured from a center of a circle of best fit. The radius of curvature 461 is non-zero. That is, the radiused sidewall 455 can be a radiused recess region defined by the exterior surface 163 of the dome wall 44.

While illustrated as a semi-circle or generally spherical, it is contemplated that the spherical inlet 499 can have any cross-sectional shape having at least one arcing portion such that at least a portion of the spherical inlet 499 has a non-zero radius of curvature 461.

Figure 13:
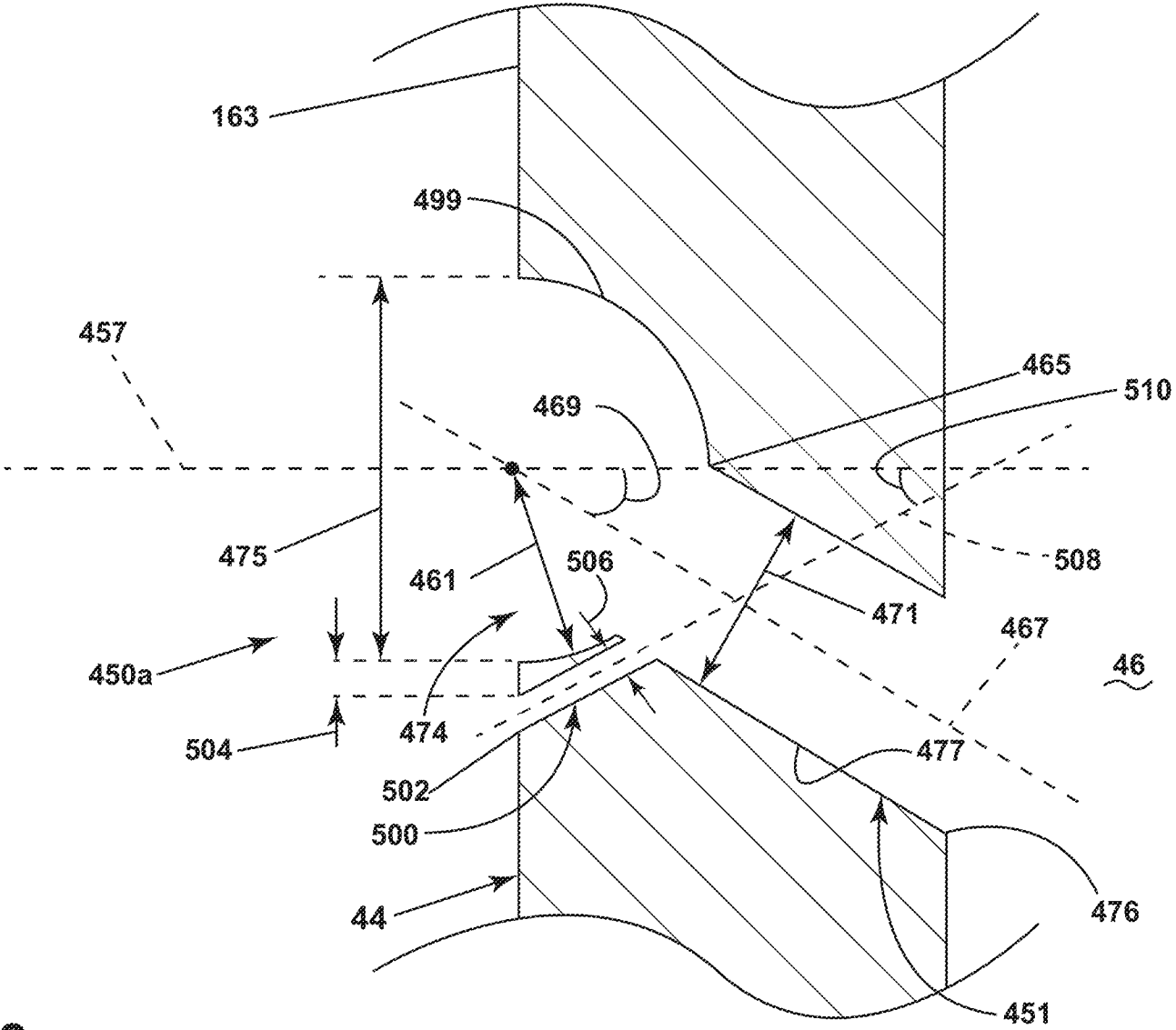
FIG. 13 is a cross-sectional view of a passage inlet of the dilution passages from the set of dilution passages of FIG. 11 taken along the line XIII-XIII.

FIG. 13 is a schematic, cross-sectional view along the XIII-XIII line of FIG. 11, further illustrating a dilution passage 450*a* of the first set of dilution passages 450. The dilution passage 450*a* includes the spherical inlet 499. The passageway 451 fluidly couples to the radiused inlet 474 defined by the spherical inlet 499 at a passageway inlet 465.

A passageway centerline 467 can be defined by the passageway 451. A passageway angle 469 is be defined between the passageway centerline 467 and the inlet centerline 457. The passageway angle 469 can have an angle measure that is between +90° and 90°. More specifically, the passageway angle 469 can be in a range from −70° to 70°.

A passageway diameter 471 is measured across the passageway 451 or between sidewalls 477. The passageway diameter 471 can be measured perpendicular to the passageway centerline 467. While illustrated remaining the same, it is contemplated that the passageway diameter 471 can increase or decrease between the passageway inlet 465 and an outlet 476.

A radiused inlet diameter 475 can be measured across the radiused inlet 474. While illustrated as a semi-circle, the cross section of the spherical inlet 499 can be any shape having at least a portion having a non-zero radius of curvature.

The radiused inlet diameter 475 is illustrated, by way of example, as twice the radius of curvature 461. The radius of curvature 461 is the radius of curvature of the radiused inlet 474 or a portion of the spherical inlet 499. It is contemplated the radiused inlet diameter 475 can be twice the radius of curvature of any curved portion of the radiused inlet 474 or spherical inlet 499.

While the radius of curvature 461 is illustrated as having a center point in the plane of the exterior surface 163 of the dome wall 44, it is contemplated, in a different and non-limiting example, that the center point of the radius of curvature 461 can be located outside or not in the plane of the exterior surface 163 of the dome wall 44.

A ratio of the radiused inlet diameter 475 to the passageway diameter 471 is greater than 1. More specifically, the ratio of the radiused inlet diameter 475 to the passageway diameter 471 is greater than or equal to 1.05 and less than or equal to 6. In other words, the radiused inlet diameter 475 is greater than the passageway diameter 471.

An outlet 476, fluidly couples the passageway 451 to the combustion chamber 46.

The aperture 500 can fluidly connect compressed air to the passageway 451. As illustrated, by way of example, an aperture inlet 502 can be located at the exterior surface 163 of the dome wall 44. The aperture inlet 502 can be adjacent to the radiused inlet 474, where the term adjacent means that a distance 504 measured from the aperture 500 to the radiused inlet 474 is less than the passageway diameter 471. The location of the aperture 500 adjacent to the radiused inlet 474 is selected to reduce or eliminate flow separation in the passageway 451.

An aperture diameter 506 can be the greatest distance measured across the aperture 500. The aperture diameter 506 can be less than 50% of the passageway diameter 471. It is further contemplated that an aperture area of at least one cross-section of the aperture 500 is less than 50% of a passageway area of at least one cross-section of the passageway 451.

An aperture centerline 508 can be defined by the aperture 500. While illustrated as generally linear, the aperture centerline 508 can curve. An aperture angle 510 is defined between the aperture centerline 508 and the inlet centerline 457. The aperture angle 510 can be between +90° and −90°. More specifically, the aperture angle 510 can be in a range from −70° to 70°.

Optionally, the aperture 500 can be a plurality of apertures. That is, any number of apertures 500 are contemplated. By way of non-limiting example, the plurality of apertures can be circumferentially spaced about at least a portion of a radiused inlet 574. The plurality of apertures can form different aperture angles with the inlet centerline 457, have different cross-sectional areas or shapes, or can be a plexus design, where fluid from one aperture can flow into another aperture upstream of the combustion chamber 46.

Figure 14:
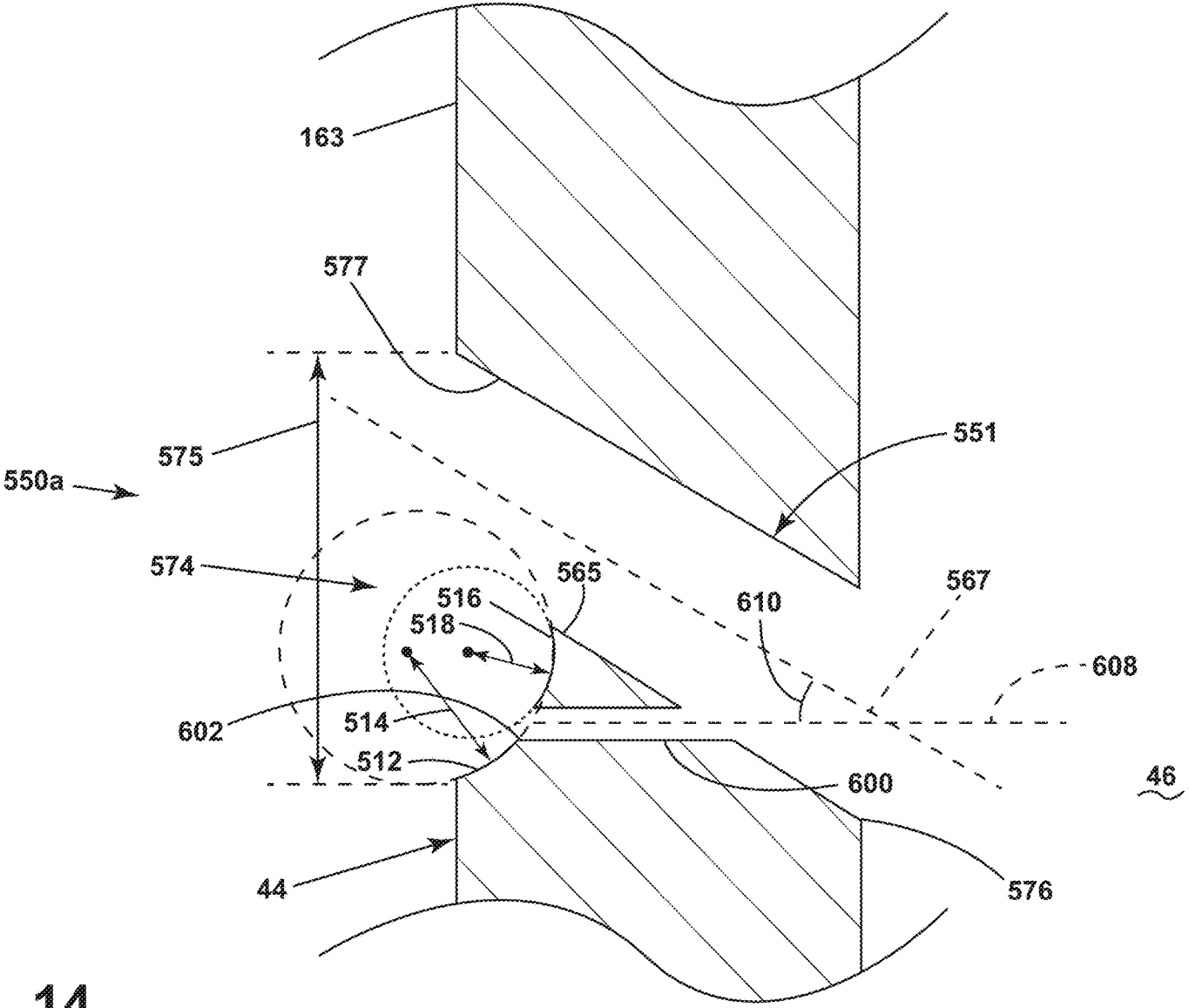
FIG. 14 is a variation of the cross-sectional view of a passage inlet of the dilution passages from the set of dilution passages of FIG. 11.

FIG. 14 illustrates a dilution passage 550*a*. The dilution passage 550*a* is similar to the dilution passage 450*a* of FIG. 13, therefore, like parts will be identified with like numerals increased by 100, with it being understood that the description of the like parts of the dilution passage 450*a* applies to the dilution passage 550*a* unless otherwise noted.

The dilution passage 550*a* can include a radiused inlet 574. The radiused inlet 574 can be a radiused recess region defined by the exterior surface 163 of the dome wall 44. While illustrated as a linear or flat surface, the exterior surface 163 can be curved.

The radiused inlet 574 includes at least a portion having a changing radius. That is, a first portion 512 of the radiused inlet 574 can have a first radius of curvature 514 and a second portion 516 of the radiused inlet 574 can have a second radius of curvature 518.

The radiused inlet 574 can also be partially defined by a side 577 of a passageway 551. A passageway centerline 567 can be defined by the passageway 551, as the passageway 551 extends from a passageway inlet 565 to a passageway outlet 576.

A radiused inlet diameter 575 can be measured across the radiused inlet 574. While illustrated as a portion of an oval, the cross section of the radiused inlet 574 can be any shape having at least a portion having a non-zero radius of curvature. That is, only a portion of the radiused inlet 574 needs to be radiused. As illustrated, by way of example, the radiused inlet 574 can have a portion, illustrated by side 577, that is not radiused. In other words, only part of a hole or inlet at the dome wall 44 or combustor liner 38 (FIG. 3) needs to be radiused to be considered a radiused inlet.

An aperture 600, similar to the aperture 500 (FIG. 13), fluidly couples the radiused inlet 574 and the passageway 551. As illustrated, by way of example, an aperture inlet 602 can be located at or between the first portion 512 or the second portion 516 of the radiused inlet 574.

An aperture centerline 608 can be defined by the aperture 500. While illustrated as generally linear, the aperture centerline 608 can curve. An aperture angle 610 is defined between the aperture centerline 608 and the passageway centerline 567. The aperture angle 610 can be in a range from 0° to 90°.

Optionally, the aperture 600 can be a plurality of apertures. That is, any number of apertures 600 are contemplated. The plurality of apertures can have different cross sections or can be a plexus design, where fluid from one aperture can flow into another aperture upstream of the combustion chamber 46.

Benefits of the present disclosure include a combustor suitable for use with a hydrogen-containing fuel. As outlined previously, hydrogen-containing fuels have a higher flame temperature than traditional fuels (e.g., fuels not containing hydrogen). That is, hydrogen or a hydrogen mixed fuel typically has a wider flammable range and a faster burning velocity than traditional fuels such petroleum-based fuels, or petroleum and synthetic fuel blends. These high burn temperatures of hydrogen-containing fuel mean that additional insulation is needed between the ignited hydrogen-containing fuel and surrounding components of the turbine engine or gas turbine engine (e.g., the dome wall, the inner/outer liner, and other parts of the turbine engine). The combustor, as described herein, includes diffusion passages or apertures that create a layer of insulation (e.g., the curtain of compressed air) between the ignited hydrogen-containing fuel and the dome wall or combustor liner. The curtain of compressed air is further used to shape the flame within the combustion chamber, which in turn results in an enhanced control of the flame shape profile. By shaping the flame the liner wall temperature, the dome wall temperature, the combustor exit temperature profile and pattern of the flame/gas exiting the combustor can be controlled. This control or shaping can further ensure that the combustion section or otherwise hot sections of the turbine engine do not fail or otherwise become ineffective by being overly heated, thus increasing the lifespan of the turbine engine. That is, the dilution passages or dilution passages with apertures, as described herein, ensure an even, uniform, or otherwise desired flame propagation within the combustor.

Benefits associated with using hydrogen-containing fuel over conventional fuels include an eco-friendlier engine as the hydrogen-containing fuel, when combusted, generates less carbon pollutants than a combustor using conventional fuels. For example, a combustor including 100% hydrogen-containing fuel (e.g., the fuel is 100% $H_2$) would have zero carbon pollutants. The combustor, as described herein, can be used in instances where 100% hydrogen-containing fuel is used.

Further benefits associated with using hydrogen-containing fuel over conventional fuels include a turbine engine that can utilize less fuel due to higher heating vale of fuel to achieve same turbine inlet temperatures. For example, a conventional turbine engine using conventional fuels will require more fuel to produce the same amount of work or engine output as the present turbine engine using hydrogen-containing fuels. This, in turn, means that either less amount of fuel can be used to generate the same amount of engine output as a conventional turbine engine, or the same amount of fuel can be used to generate an excess of increased engine output when compared to the conventional turbine engine.

Additional benefits associated with aspects of the present disclosure include using a radiused inlet, apertures, or combination to reduce or eliminate flow separation at the entry (passageway inlet) of a dilution hole or dilution holes. While illustrated as reducing or eliminating flow separation by use of the radiused inlet, apertures, or combination in dilution passages, it is contemplated that the radiused inlet, apertures, or combination thereof can be used in any passage within the turbine engine to reducing or eliminating flow separation.

To the extent not already described, the different features and structures of the various embodiments can be used in combination, or in substitution with each other as desired. That is, any dilution hole coupling compressed air to the combustion chamber can include one or more of the aspects described herein. By way of non-limiting example, one or more dilution holes can include a channel or single radiused inlet fluidly coupled to one or more passages. By way of further non-limiting example, one or more dilution holes can include a chambered portion or at least one aperture. That one feature is not illustrated in all of the embodiments is not meant to be construed that it cannot be so illustrated, but is done for brevity of description. Thus, the various features of the different embodiments can be mixed and matched as desired to form new embodiments, whether or not the new embodiments are expressly described. Further, the radiused inlet coupled to the passageway can be applied to any flow path providing flow through one or more portions or components of a turbine engine. That is, aspects of the disclosure are illustrated in the context of the dilution holes of a combustor, however, other passages within the turbine engine are contemplated. All combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects are provided by the subject matter of the following clauses:

A combustor for a turbine engine comprising a dome wall, a combustor liner extending from the dome wall, a combustion chamber at least partially defined by the dome wall and the combustor liner, a set of fuel cups circumferentially spaced along the dome wall relative to a combustor centerline, with each fuel cup having a fuel cup centerline, and a set of dilution passages extending through the dome wall or the combustor liner to direct air into the combustion chamber, wherein at least one dilution passage of the set of dilution passages comprises a radiused inlet fluidly coupled to a compressed air source, an outlet downstream of the radiused inlet and fluidly coupled to the combustion chamber, and a passageway fluidly coupling the radiused inlet to the outlet.

A combustor for a turbine engine comprising a dome wall, a combustor liner extending from the dome wall, a combustion chamber at least partially defined by the dome wall and the combustor liner, a set of fuel cups circumferentially spaced along the dome wall relative to a combustor centerline, with each fuel cup having a fuel cup centerline, and a set of dilution passages extending through the dome wall or the combustor liner to direct air into the combustion chamber, wherein at least one dilution passage of the set of dilution passages comprises inlet fluidly coupled to a compressed air source, an outlet downstream of the radiused inlet and fluidly coupled to the combustion chamber, a passageway fluidly coupling the inlet to the outlet, and an aperture spaced from the inlet of the passageway, wherein the aperture fluidly couples the compressed air source and the passageway.

A turbine engine comprising a fan section, a compressor section, a combustion section having a combustor, and a turbine section in axial flow arrangement and defining a turbine engine axis of rotation, wherein the combustor comprises a dome wall, a combustor liner extending from the dome wall, a combustion chamber at least partially defined by the dome wall and the combustor liner, a set of fuel cups circumferentially spaced along the dome wall relative to a combustor centerline, with each fuel cup having a fuel cup centerline, and a set of dilution passages extending through the dome wall or the combustor liner to direct air into the combustion chamber, wherein at least one dilution passage of the set of dilution passages comprises a radiused inlet fluidly coupled to a compressed air source, an outlet downstream of the radiused inlet and fluidly coupled to the combustion chamber, and a passageway fluidly coupling the radiused inlet to the outlet.

The combustor of any preceding clause, further comprising a channel having a radiused sidewall forming the radiused inlet.

The combustor of any preceding clause, wherein a passageway inlet is defined at an intersection of the radiused inlet and the passageway.

The combustor of any preceding clause, wherein the channel spans at least two passageway inlets.

The combustor of any preceding clause, wherein the channel spans at least two radiused inlets.

The combustor of any preceding clause, further comprising a flow adjustor located adjacent the passageway inlet.

The combustor of any preceding clause, wherein the flow adjustor recesses into or protrudes from a sidewall of the passageway.

The combustor of any preceding clause, wherein the flow adjustor is a distance from the passageway inlet, wherein the distance is less than three times the passageway diameter.

The combustor of any preceding clause, wherein the flow adjustor is a distance from the passageway inlet, wherein the distance is less than 70% of the distance between the passageway inlet and an outlet measured along a passageway centerline or a sidewall.

The combustor of any preceding clause, wherein the flow adjustor is uniformly distributed about the circumference of the passageway.

The combustor of any preceding clause, wherein the flow adjustor is non-uniformly distributed about the circumference of the passageway.

The combustor of any preceding clause, wherein one or more of the flow adjustors vary in shape or size from the other flow adjustors.

The combustor of any preceding clause, wherein a radiused inlet diameter of the radiused inlet is greater than a passageway diameter of the passageway.

The combustor of any preceding clause, wherein the radiused inlet diameter is twice a radius of curvature of the radiused inlet or the radiused sidewall.

The combustor of any preceding clause, further comprising a raised inlet portion at least partially defining the radiused inlet.

The combustor of any preceding clause, wherein the raised inlet portion extends a boss distance from an exterior surface of the dome wall or an outer surface of the combustor liner to an outermost extent.

The combustor of any preceding clause, wherein the boss distance is between 1% and 200% of a radius of curvature of the radiused inlet.

The combustor of any preceding clause, wherein the radiused inlet defines an inlet centerline and the passageway defines a passageway centerline, wherein a passageway angle is defined between the passageway centerline and the inlet centerline.

The combustor of any preceding clause, wherein the passageway angle is between +90° and −90°.

The combustor of any preceding clause, wherein the passageway angle is between +70° and −70°.

The combustor of any preceding clause, wherein the passageway is a plurality of passageways fluidly coupling the radiused inlet and the combustion chamber.

The combustor of any preceding clause, further comprising spherical inlet defining the radiused inlet, wherein the spherical inlet has a non-zero radius of curvature.

The combustor of any preceding clause, wherein the spherical inlet includes a radiused portion and a linear portion.

The combustor of any preceding clause, wherein the spherical inlet has a first radiused portion and a second linear portion defined by a sidewall of the passageway.

The combustor of any preceding clause, further comprising an aperture fluidly coupling the compressed air source and the passageway.

The combustor of any preceding clause, wherein the aperture has an aperture area that is less than 50% of a passageway area.

The combustor of any preceding clause, wherein the aperture is a plurality of apertures.

The combustor of any preceding clause, further comprising an aperture angle defined between an aperture centerline and an inlet centerline, wherein the aperture angle is in a range from 0° to 90°.

What is claimed is:

1. A combustor for a turbine engine comprising:

a dome wall;

a combustor liner extending from the dome wall;

a combustion chamber at least partially defined by the dome wall and the combustor liner;

a set of fuel cups circumferentially spaced along the dome wall relative to a combustor centerline, with each fuel cup having a fuel cup centerline; and a set of dilution passages extending through the dome wall or the combustor liner to direct air into the combustion chamber, wherein at least one dilution passage of the set of dilution passages comprises:

a radiused inlet fluidly coupled to a compressed air source;

an outlet downstream of the radiused inlet and fluidly coupled to the combustion chamber;

a passageway fluidly coupling the radiused inlet to the outlet; and a channel having a radiused sidewall forming the radiused inlet, wherein a passageway inlet is defined at an intersection of the radiused inlet and the passageway, and wherein the channel spans at least two passageway inlets;

wherein at least a portion of a compressed air flow from the compressed air source is provided to the set of dilution passages which defines a dilution airflow to the combustion chamber to direct and shape a flame.

2. The combustor of claim 1, wherein the channel is an annular channel that circumferentially fluidly connects the at least two passageway inlets.

3. The combustor of claim 1, wherein the channel defines a channel centerline and the radiused inlet defines an inlet centerline, wherein the channel centerline is perpendicular to the inlet centerline.

4. The combustor of claim 1, wherein the compressed air source is a low pressure compressor or a high pressure compressor.

5. The combustor of claim 1, wherein a radiused inlet diameter of the radiused inlet is greater than a passageway diameter of the passageway.

6. The combustor of claim 5, wherein the radiused inlet diameter is twice a radius of curvature of the radiused sidewall.

7. The combustor of claim 1, further comprising a flow adjustor located adjacent at least one passageway inlet of the at least two passageway inlets, wherein the flow adjustor recesses into or protrudes from a sidewall of the passageway.

8. A combustor for a turbine engine comprising:
- a dome wall;
- a combustor liner extending from the dome wall;
- a combustion chamber at least partially defined by the dome wall and the combustor liner;
- a set of fuel cups circumferentially spaced along the dome wall relative to a combustor centerline, with each fuel cup having a fuel cup centerline, and wherein each fuel cup of the set of fuel cups includes a swirler; and
- a set of dilution passages extending through the dome wall or the combustor liner to direct air into the combustion chamber, wherein at least one dilution passage of the set of dilution passages comprises:
  - a radiused inlet fluidly coupled to a compressed air source, wherein the radiused inlet is defined by a spherical inlet;
  - an outlet downstream of the radiused inlet and fluidly coupled to the combustion chamber; and
  - a passageway fluidly coupling the radiused inlet to the outlet;
- wherein a first part of a compressed air is fed to the fuel cup as a swirled airflow via the swirler, and a second part of the compressed air is fed to the set of dilution passages which provides a dilution airflow to the combustion chamber to direct and shape a flame.

9. The combustor of claim 8, wherein each fuel cup of the set of fuel cups includes a flare cone, wherein the swirled airflow from the swirler and a flow of fuel are mixed within the flare cone.

10. The combustor of claim 8, wherein the radiused inlet includes a radiused portion and a linear portion.

11. The combustor of claim 8, further comprising a flow adjustor located adjacent a passageway inlet defined at an intersection of the radiused inlet and the passageway, wherein the flow adjustor recesses into or protrudes from a sidewall of the passageway.

12. A combustor for a turbine engine comprising:
- a dome wall;
- a combustor liner extending from the dome wall;
- a combustion chamber at least partially defined by the dome wall and the combustor liner;
- a set of fuel cups circumferentially spaced along the dome wall relative to a combustor centerline, with each fuel cup having a fuel cup centerline; and
- a set of dilution passages extending through the dome wall or the combustor liner to direct air into the combustion chamber, wherein at least one dilution passage of the set of dilution passages comprises:
  - a radiused inlet fluidly coupled to a compressed air source;
  - an outlet downstream of the radiused inlet and fluidly coupled to the combustion chamber;
  - a passageway fluidly coupling the radiused inlet to the outlet; and
  - a channel having a radiused sidewall forming the radiused inlet, wherein the channel is a curved groove recessed into the dome wall, wherein the radiused sidewall is defined by a portion of the dome wall;
- wherein at least a portion of a compressed air flow from the compressed air source is provided to the set of dilution passages which defines a dilution airflow to the combustion chamber to direct and shape a flame.

13. The combustor of claim 12, further comprising a flow adjustor located adjacent a passageway inlet defined at an intersection of the radiused inlet and the passageway, wherein the flow adjustor recesses into or protrudes from a sidewall of the passageway.

14. The combustor of claim 12, wherein the set of dilution passages includes at least two dilution passages having radiused inlets, and wherein the channel is an annular channel that circumferentially fluidly connects the radiused inlets.

15. A combustor for a turbine engine comprising:
- a dome wall;
- a combustor liner extending from the dome wall;
- a combustion chamber at least partially defined by the dome wall and the combustor liner;
- a set of fuel cups circumferentially spaced along the dome wall relative to a combustor centerline, with each fuel cup having a fuel cup centerline; and
- a set of dilution passages extending through the dome wall or the combustor liner to direct air into the combustion chamber, wherein at least one dilution passage of the set of dilution passages comprises:
  - a radiused inlet fluidly coupled to a compressed air source, wherein the radiused inlet has a radiused inlet diameter at least twice a radius of curvature of the radiused inlet or a radiused sidewall;
  - an outlet downstream of the radiused inlet and fluidly coupled to the combustion chamber; and
  - a passageway fluidly coupling the radiused inlet to the outlet;
- wherein at least a portion of a compressed air flow from the compressed air source is provided to the set of dilution passages which defines a dilution airflow to the combustion chamber to direct and shape a flame.

16. The combustor of claim 15, further comprising a raised inlet portion at least partially defining the radiused inlet.

17. The combustor of claim 15, wherein the radiused inlet defines an inlet centerline and the passageway defines a passageway centerline, wherein a passageway angle is defined between the passageway centerline and the inlet centerline.

18. The combustor of claim 17, wherein the passageway angle is between +90° and −90°.

19. The combustor of claim 15, further comprising an aperture fluidly coupling the compressed air source and the passageway.

20. The combustor of claim 15, further comprising an aperture fluidly coupling the compressed air source and the passageway.

* * * * *